US012734411B2

(12) United States Patent
Husemeyer

(10) Patent No.: US 12,734,411 B2
(45) Date of Patent: Sep. 15, 2026

(54) ROTATIONALLY BALANCED SMART BALL

(71) Applicant: Sportable Technologies Ltd., London (GB)

(72) Inventor: Peter Husemeyer, Tunbridge Wells (GB)

(73) Assignee: Sportable Technologies Ltd., Greenlands Lane (GB)

( * ) Notice: Subject to any disclaimer, the term of this patent is extended or adjusted under 35 U.S.C. 154(b) by 0 days.

(21) Appl. No.: 19/389,931

(22) Filed: Nov. 14, 2025

(65) Prior Publication Data

US 2026/0069929 A1 Mar. 12, 2026

Related U.S. Application Data

(63) Continuation of application No. PCT/EP2024/059404, filed on Apr. 5, 2024.

(30) Foreign Application Priority Data

Sep. 8, 2023 (GB) ..... 2313706

(51) Int. Cl.
*A63B 43/04* (2006.01)
*A63B 41/00* (2006.01)
*A63B 41/02* (2006.01)

(52) U.S. Cl.
CPC ..... *A63B 43/04* (2013.01); *A63B 41/02* (2013.01); *A63B 2041/005* (2013.01); *A63B 2220/833* (2013.01)

(58) Field of Classification Search
CPC ... A63B 2041/005; A63B 41/02; A63B 41/04; A63B 41/08; A63B 41/085; A63B 43/04;
(Continued)

(56) References Cited

U.S. PATENT DOCUMENTS 5,709,622 A * 1/1998 Spiegel ..... A63B 41/08 473/607
5,779,575 A * 7/1998 Hsieh ..... A63B 43/06 473/570

(Continued)

FOREIGN PATENT DOCUMENTS

CN 214209358 U * 9/2021
CN 116271745 A 6/2023
GB 2588756 5/2021

OTHER PUBLICATIONS

International Search Report and Written Opinion for PCT/EP2024/059404 dated Jun. 20, 2024.

*Primary Examiner* — Christopher R Legendre
(74) *Attorney, Agent, or Firm* — Christopher M. Scherer; Godfrey & Kahn, S.C.

(57) ABSTRACT

At least one device is mounted on or over the bladder wall of an inflatable ball such that a center of mass of the device is located away from a center of the inflatable interior of the ball. The device includes an electronic device. The center of mass of the device defines a first point on the bladder wall coincident with or closest to the center of mass of the device and a second point on the bladder wall opposite the first point. The ball comprises a distributed balancing mass for at least partially rotationally balancing the mass of the device. The distributed balancing mass comprises one or more balancing mass elements on or over the bladder wall. The balancing mass elements are arranged at a plurality of locations spaced around the second point on the bladder wall and closer to the second point than the first point.

15 Claims, 19 Drawing Sheets

(58) Field of Classification Search
CPC .... A63B 2220/10–64; A63B 2220/833; A63B 2243/0025; A63B 2243/0037; A63B 2243/0066; A63B 2243/007; A63B 2243/0095
See application file for complete search history.

(56) References Cited

U.S. PATENT DOCUMENTS

| | | | | |
|---|---|---|---|---|
| 2019/0091520 | A1 | 3/2019 | Corbeil et al. | |
| 2019/0344144 | A1 | 11/2019 | San Juan | |
| 2022/0409963 | A1 | 12/2022 | Savage et al. | |
| 2026/0069929 | A1* | 3/2026 | Husemeyer ..... | A63B 41/02 |

* cited by examiner

ROTATIONALLY BALANCED SMART BALL

CROSS-REFERENCE TO RELATED APPLICATIONS

The present application is continuation of International Application No. PCT/EP2024/059404 filed Apr. 5, 2024 which application was published on Mar. 13, 2025, as WO2025/051398, and further claims priority to GB Application No. 2313706.0 filed Sep. 8, 2023, the contents of which are incorporated herein by reference in their entireties.

FIELD OF THE INVENTION

The invention relates to inflatable balls, particularly sports balls, containing electronic devices and to techniques for balancing the additional mass introduced by the electronic devices.

BACKGROUND

Data collection and usage has become a vital part of modern-day sports and are only likely to increase in importance. Data collection in sports is beneficial for many reasons. Firstly, data collection is valuable for training, as it allows the athletes to gain a better knowledge of their performance and key statistics. For example, the total distance covered in a match by a certain player may be a useful indicator of their fitness and level of participation. Secondly, statistics and data figures have become an increasingly important aspect of the viewer experience during sporting events.

Increasingly, sensors and trackers are being incorporated into sports balls. Such ball devices allow spectators to see statistics such as speed, distance, number of passes, or the force exerted by an athlete during kicking, for example. There are two main ways of introducing electronics into the ball. A first involves mounting the electronics near the centre of the ball, which keeps the ball rotationally balanced. This technique has the problem that it can be difficult to manufacture an inflatable sports ball in which an electronic device is suspended in the centre of the ball. It also makes it practically impossible to access the electronic device after manufacture. A second option is to mount the electronics on the periphery of the ball. The electronics can either be mounted to the inside surface of the bladder or dropped into a recess in the bladder from the outside of the sports ball, for example. Balls constructed in line with this technique are generally easier to manufacture and may allow more convenient access to the electronic device for maintenance and charging. However, this option has the downside that it tends to unbalance the ball.

It is known to offset the mass of an electronic device mounted on the periphery of the sports ball by placing a balancing mass opposite to the electronic device. However, this solution has the problem that it introduces a preferred rotation axis of the ball or otherwise changes the way the ball rotates about other axes. It is desirable to devise a means of rotationally balancing a sports ball that does not suffer from this problem.

SUMMARY OF INVENTION

In accordance with a first aspect of the invention, there is provided an inflatable ball comprising: a bladder having a bladder wall defining an inflatable interior of the ball; at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing the mass of the at least one device, the distributed balancing mass comprising one or more balancing mass elements on or over the bladder wall, the one or more balancing mass elements being arranged at a plurality of locations spaced around the second point on the bladder wall and closer to the second point than the first point; wherein the distributed balancing mass comprises one of: a) at least four balancing mass elements, the balancing mass elements being arranged substantially at or substantially evenly distributed by mass with respect to each of at least four balancing points equally spaced around the second point and closer to the second point than the first point; or b) one or more mass balancing elements arranged on or over the bladder wall along one or more tracks along the bladder wall defining substantially all or one or more parts of the circumference of a circle or an ellipse.

The inventor has recognised that in order to balance the mass of an electronic device mounted at or near the periphery of the sports ball, it is advantageous not to simply provide a balancing mass opposite the device (the second point), but to space the balancing mass at a series of locations around this opposite point.

Since the balancing mass is closer to the second point than it is to the first point, it will still achieve the effect of moving the centre of mass closer to the centre of the ball, but does this while reducing the effect the balancing mass will have on different rotation axes of the ball.

A bladder may be used to describe any component which provides an inflatable ball with its general shape and rigidity once inflated. A bladder may be elastic and may be made of rubber or any other elastic polymer, or non-elastic and made of a stiff polymer, for example. The bladder defines an inflatable interior of the ball allowing for inflation of the inflatable ball to a substantially rigid form. The bladder wall is considered to be any part of the bladder that defines the perimeter between the inside and the outside of the bladder. This will generally be a thin membrane-like structure, but may also include integrally moulded wall features, such as a mounting point for the electronic device, or feature regions adhered over an opening through the bladder to make the bladder airtight. For example, some embodiments may feature a pocket-like recess into which the electronics are inserted that is moulded into the bladder wall or arranged in an opening through the bladder.

A bladder is usually encased in a layer of material which forms an outer surface of an inflatable ball, which is often the case for traditional soccer balls. However, the bladder itself may form the outermost layer of the inflatable ball. The bladder may also have additional layers between itself and an outer layer. Any outermost layer may be used with the present arrangement.

The devices will generally be arranged on or over an inside surface of the bladder wall. That is, they will generally be located inside the inflatable interior defined by the bladder wall. In this position, the devices are less likely to interfere with the external appearance or feel of the ball. However, in some embodiments the devices could be arranged on the outer surface of the bladder wall, particularly in a recessed pocket in the bladder wall.

The term "distributed balancing mass" will be understood to encompass several discrete balancing mass elements, that can be individually positioned on or over the bladder wall around the second point, or a single balancing mass element whose shape and/or dimensions allow it to extend at least partially around the second point, preferably at least 50% of the way around the second point, most preferably substantially entirely around the second point. As will be discussed in more detail below, an example of a suitable singular balancing mass element may be a continuous strip that may, for example, extend in a closed loop around the second point.

It should be noted that a balancing mass element may also be provided substantially at the second point in addition to those spaced around the second point. Preferably all balancing mass elements that are provided in the ball are provided closer to the second point than the first point and preferably no balancing mass element is arranged at the second point; however, this is not essential. Preferably, all balancing mass elements are provided in a range more than 50% and less than 95% of the distance along the bladder wall from the first point to the second point, more preferably in a range more than 55% and less than 90% of the distance along the bladder wall from the first point to the second point.

In one option of present aspect, the distributed balancing mass comprises at least four balancing mass elements, the balancing mass elements being arranged substantially at or substantially evenly distributed by mass with respect to each of at least four balancing points equally spaced around the second point and closer to the second point than the first point. In comparative examples, the one or more balancing mass elements comprises one or more balancing mass elements arranged substantially at or substantially evenly distributed by mass with respect to each of at least two balancing points equally spaced around the second point, preferably at least three balancing points equally spaced around the second point. It would also be possible for balancing mass elements arranged substantially at or substantially evenly distributed by mass with respect to each of at least six balancing points equally spaced around the second point, or at least nine balancing points equally spaced around the second point. As will be described below, preferably the number of balancing mass elements is a multiple of three. Each balancing mass element may be located substantially at a respective balancing mass point. Alternatively, a plurality of balancing mass elements may be divided into a plurality of sets of balancing mass elements, wherein each set of balancing mass elements is substantially evenly distributed by mass with respect to a respective balancing point. A set of balancing mass elements may be considered evenly distributed by mass with respect to a balancing point when the centre of mass of the set of balancing mass elements substantially coincides with the balancing point or wherein the balancing point is the point on the surface of the bladder closest to the centre of mass of the set of balancing mass elements. It should be noted here that each balancing point will typically be a point on the bladder wall; however, the balancing points could also be points over the bladder wall. For example, if the at least one device is inset towards the centre of the ball from the bladder wall, then it may be desirable to balance the at least one device with respect to balancing points that are likewise inset. This could be done by mounting the balancing masses so that they are spaced away from the inside surface of the bladder wall.

It was noted by the inventor that it is particularly advantageous in terms of balancing to have three balancing points, so that the balancing masses and the first point and/or the centre of mass of the at least one device define the vertices of a tetrahedron. However, when few balancing points are used, as is the case here, this may require these balancing mass elements to be individually quite large. It was found that that this can lead to irregular bouncing of the ball if the ball bounced close to one of these balancing mass elements. In comparative examples, a plurality of balancing mass elements may be evenly distributed by mass with respect to each balancing point. For example, a respective set of balancing mass elements may be distributed around each balancing point, so that the centre of mass of that set substantially coincides with the respective balancing point. However, in accordance with the present aspect, at least four balancing mass elements at four balancing points are used, or one or more balancing mass elements arranged along tracks are used, which avoids the problems noted above In comparative examples, the distributed balancing mass is one in which the device and the balancing mass elements are arranged at the four vertices of a substantially regular tetrahedron. In some such examples, the one or more balancing mass elements comprises one or more balancing mass elements arranged substantially at or substantially evenly distributed by mass with respect to each of three balancing points (preferably evenly) spaced around the second point, the three balancing points together with the first point and/or the centre of mass of the of the at least one device preferably defining four vertices of a tetrahedron, most preferably a substantially regular tetrahedron. In some cases, the mass distribution of the at least one device may be such that a substantially regular tetrahedron shape is not ideal for balancing; however, it may be preferred that the three balancing points are nonetheless evenly spaced around the second point, e.g. so that the three balancing points define three vertices of an equilateral triangle. This (regular) tetrahedron shape is particularly suited to moving the centre of mass towards the centre of the ball while also preventing the appearance of preferred rotation axes of the ball.

Since three balancing mass elements that, together with the first point/centre of mass of the at least one device, define a regular tetrahedron results in a substantially perfectly balanced ball where all have the same mass, consider the case in which the balancing masses each have half the mass of the at least one device. This will balance half of the mass of the at least one device. Next, consider rotating the tetrahedron around the axis passing through the first point/centre of mass of the of the at least one device and through the centre of the three balancing points. If three more balancing points are defined by this new tetrahedron, and three more balancing masses placed at these new balancing points, each having half the mass of the at least one device, then these will again balance half the mass of the at least one device. The combined effect of the six balancing masses, each with half the mass of the at least one device, will be essentially identical to the effect of three balancing masses each having the same mass as the at least one device. In accordance with this principle, the ball may comprise at least six balancing mass elements arranged substantially in a single plane, wherein each balancing mass element has two corresponding balancing mass elements which, together with the first point and/or the centre of mass of the at least one device, define four vertices of a substantially regular tetrahedron. In other words, the ball may comprise at least six balancing mass elements arranged substantially in a single plane, wherein each balancing mass element has, among the other of the at least six balancing mass elements, two corresponding balancing mass elements, wherein each balancing mass element together with its two corresponding balancing mass elements and together with the first point and/or the centre of mass of the at least one device defines four vertices of a substantially regular tetrahedron. It will be appreciated that these balancing masses can be divided into smaller and smaller mass elements defining more and more substantially regular tetrahedra together with the first point and/or the centre of mass of the at least one device, tending towards the balancing mass elements defining a circular track along the bladder wall defining a cone together with the first point. In line with the above, it will be preferred that the number of balancing masses is a multiple of three, i.e. such that each set of three may define a tetrahedron with the first point. However, once the balancing mass elements are sufficiently small and sufficiently many, this multiple of three preference for good balancing becomes less important, i.e. the effect of omitting one or two balancing mass elements becomes negligible.

As indicated above, a preferred arrangement is one in which the first point and the distributed balancing mass define a cone shape, with the first point being the tip of the cone and the distributed balancing mass extending around the base of the cone. Much like the tetrahedron shape described above, this shape is particularly suited to moving the centre of mass towards the centre of the ball while also preventing the appearance of preferred rotation axes of the ball.

In some embodiments, the distributed balancing mass comprises at least five balancing mass elements arranged substantially at or substantially evenly distributed by mass with respect to five balancing points equally spaced around the second point, preferably at least eight balancing mass elements arranged substantially at or substantially evenly distributed by mass with respect to eight balancing points equally spaced around the second point, most preferably at least ten balancing mass elements arranged substantially at or substantially evenly distributed by mass with respect to ten balancing points equally spaced around the second point. More balancing mass elements arranged at more balancing points reduces the required mass of each balancing mass element and thus reduces irregular bouncing. As more balancing mass elements are arranged at more balancing points, the balancing mass elements will more closely define a cone shape with the first point, as discussed above, which is advantageous in how it balances the mass of the electronic device.

As indicated, the one or more balancing mass elements may comprise one or more mass balancing elements arranged along one or more tracks along the bladder wall defining all or part(s) of the circumference of a circle or an ellipse, wherein preferably the first point lies perpendicular to the plane of the circle or the ellipse from the centre of the circle or the ellipse. A cone with a circular base is particularly suited to spherical balls. A cone with an elliptical base is suited to balls whose shape is a prolate spheroid, such as rugby balls or American footballs. It will be noted that these latter ball shapes already have a preferred rotation axis; however, the present balancing arrangement preserves this balance so that a ball with an electronic device, balanced in this way, behaves substantially the same as a standard ball without any electronic devices. It will be appreciated that the "tracks" described here could be formed by continuous balancing mass elements, such as a strip, or could be formed by a series of balancing mass elements arranged in a line, as will be described in more detail below. A single balancing mass element may define a track where the balancing mass element is elongate along the surface of the bladder, preferably having a length along the surface of the bladder at least twice as long as a width along the bladder wall, more preferably at least three times as long, more preferably at least five times as long, most preferably at least ten times as long as the width. A series of balancing mass elements may define a track where at least three balancing mass elements are provided, with each balancing mass element being spaced from the next balancing mass element by no more than 5 cm, preferably no more than 4 cm, preferably no more than 3 cm, most preferably no more than 2 cm. The closer the elements are together, the more may be arranged in a track of given length and so the smaller each balancing mass element may be. Adjacent balancing mass elements within the track are preferably spaced from one another along the bladder wall by a distance that is no more than twice the length of each balancing mass element along the direction of spacing, preferably no more than the length of each balancing mass element along the direction of spacing. Preferably, where a track is defined by a series of balancing mass elements, the track comprises at least five balancing mass elements, most preferably at least ten balancing mass elements.

Another embodiment foreseen is one in which the at least one device comprises a first device and a second device, wherein the one or more tracks along the bladder wall pass through first and second balancing points spaced around the second point and define part(s) of the circumference of a circle or an ellipse passing between the first and second devices. In one variant of this embodiment, the first device is positioned at or over a first vertex of a regular tetrahedron whose vertices are located in the bladder wall of the ball, and the second device is positioned at or over a second vertex. In this case, the first and second balancing points may be the third and fourth vertices of this tetrahedron. The balancing masses then define one or more tracks passing through the first and second balancing points and preferably also the second point.

Preferably, the one or more tracks extend along at least 50% of the circumference of the circle or ellipse, preferably at least 60%, more preferably at least 70%, more preferably at least 80%, most preferably wherein the wherein the one or more tracks extend along substantially the whole of the circumference of the circle or ellipse. As mentioned, there may be at least two separate tracks extending along at least 50%, 60%, 70%, or 80% of the circumference or substantially all of the circumference of the circle or ellipse, preferably at least three separate tracks. Alternatively, there may be one continuous track, preferably extending along substantially all of the circumference of the circle or ellipse.

In a conventional arrangement in which the mass of the device is offset by a balancing mass on the opposite side of the ball, the balancing mass generally has substantially the same mass as the mass of the device. However, in the present embodiment, balancing masses are provided between the first and second points. Therefore, typically, the balancing masses will have a total mass of at least 1.5 times the mass of the at least one device, preferably at least 2 times the mass of the at least one device, more preferably at least 2.5 times the mass of the at least one device, most preferably at least 3 times the mass of the at least one device. Preferably, the balancing masses will have a total mass of less than 8 times the mass of the at least one device, preferably less than 6 times the mass of the at least one device, most preferably less than 4 times the mass of the at least one device. In particular, preferably the balancing masses have a total mass of between 2 times and 4 times the mass of the at least one device. The precise mass required will depend on the arrangement of the at least one device and the distance of the balancing mass elements between the first and second points. Indeed, in the above described arrangement in which a substantially regular tetrahedron shape or a cone shape is defined, it may be ideal for the balancing masses to have a total mass of approximately 3 times the mass of the at least one device.

In some embodiments, the one or more balancing mass elements are provided by balancing mass elements in or on a cover of the inflatable ball, the cover surrounding the bladder. This may be provided by small weights stitched into the cover for example; however, as will be described above, a preferred thin form balancing mass element is a weighted strip or patch, which could be incorporated into the cover.

As alluded to above, one preferable way that the balancing mass element(s) may be formed is by providing one or more continuous strips or patches, preferably adhesive strips or patches, attached on or over the bladder wall. Strips are preferred, as they may be used as tracks, described above, and may extend along the circumference of the circle or ellipse along which the distributed balancing mass is arranged. Such strips or patches may be weighted with a relatively dense material, such as a rubber. The use of strips or patches allows relatively heavy balancing mass elements to be provided with thin, easy to apply elements. The primary advantage of using these strips or patches is that they may be applied to a conventional ball bladder, meaning that balls with and without electronic devices can be manufactured using the same bladder design. They may also be thin enough that they can be applied to or over an outer surface of the bladder, allowing the balancing to be performed after the ball has been assembled and inflated, which prevents the balancing masses from interfering with inflated shape of the ball. Indeed, it will generally be preferred for the strip or patch to be as thin as possible, and so preferably each strip or patch has a thickness of no more than 5 mm, preferably no more than 4 mm, more preferably no more than 3 mm, even more preferably no more than 2 mm, most preferably no more than 1 mm, to facilitate application to an outer surface of the bladder. Alternatively, these types of balancing mass elements, as well as others, could be applied on or over an inner surface of the bladder wall. However, applying on or over the outer surface of the bladder allows for application after inflation of the bladder and also allows the bladder to be tested for balancing and rebalanced if necessary. As indicated above, while, in some embodiments, it may be preferable to attach the strips or patches on the inner or outer surface of the bladder wall, in particularly preferred embodiments, each continuous strip is provided in or attached to a cover of the inflatable ball, the cover surrounding the bladder.

A problem with providing the balancing mass elements by continuous strips is that the strip can affect how the bladder wall stretches when it inflates. Large strips of continuous thickness may therefore distort the inflated shape of the ball. Therefore, preferably, each continuous strip comprises a plurality of increased thickness portions of the strip separated (e.g. along the length of the strip) by reduced thickness portions of the strip. By providing thinner portions of the strip, which may stretch more easily when the ball is inflated, the effect of the strip on the shape of the ball is reduced. Preferably, each increased thickness portion has a largest dimension along the length of the continuous strip of no more than 4 cm, preferably no more than 2 cm, more preferably no more than 1 cm. The stretching of the strip may also be facilitated by very thin reduced thickness portions, therefore preferably, the thickness of the increased thickness portions of the continuous strip is at least twice the thickness of the thinnest part of the continuous strip, preferably at least three times the thickness of the thinnest part of the continuous strip, more preferably at least four times the thickness of the thinnest part of the continuous strip. The strip may also have a smallest thickness between each increased thickness portion of no more than 0.5 cm, preferably no more than 0.3 cm, more preferably no more than 0.2 cm, most preferably no more than 0.1 cm.

To aid with aligning one or more strips, preferably opposing ends of each continuous strip define complementary non-linear or obliquely angled end edges such that opposing end edges of one or more continuous strips may be aligned to one another by the complementary end edges. The ends of the one or more strips may therefore fit together in a jigsaw-like manner to aid alignment of the ends of the strip(s).

An alternative balancing mass type (although it is also envisaged that a mixture of types may be used) is to provide one or more balancing mass elements formed integrally with the bladder wall. This allows the bladder to be produced with the balancing mass elements already provided in the bladder wall for a predetermined device arrangement, which removes the requirement for application or insertion of separate balancing mass elements. For example, if the bladder is injection moulded, then the balancing mass elements may be defined by the injection mould.

Preferably, a plurality of balancing mass elements formed integrally with the bladder wall are formed by increased wall-thickness portions of the bladder wall. It will be appreciated that the increased wall-thickness portions have a greater wall thickness than the wall thickness of the majority of the bladder wall, or a greater wall thickness than the median wall thickness of the bladder wall. Typically, the majority area of the bladder wall, i.e. more than 50% will be of substantially constant thickness, with the increased wall thickness portions having a greater thickness than this substantially constant thickness across the majority area of the bladder wall. A minority area of the bladder wall, i.e. less than 50%, preferably less than 25%, more preferably less than 10%, most preferably less than 5%, will have an increased wall thickness compared to the remaining bladder wall area.

A problem with providing the balancing mass elements by increased wall thickness portions of the bladder wall is that the thickness of the bladder wall can affect how the bladder wall stretches when it inflates. Large contiguous regions of increased bladder wall thickness may therefore distort the inflated shape of the ball. Therefore, preferably, each increased wall-thickness portion has at least one lateral dimension of no more than 2 cm, preferably no more than 1 cm, more preferably no more than 0.5 cm. More preferably, each increased wall-thickness portion has a largest lateral dimension of no more than 2 cm, preferably no more than 1 cm, more preferably no more than 0.5 cm. Here, a lateral dimension refers to a dimension along the bladder wall surface, i.e. generally perpendicular to the bladder wall thickness direction (accounting for the fact the bladder wall defines a curved surface). By providing that the increased wall thickness portions are small in at least one, preferably each lateral direction, the affect on the inflated shape of the bladder may be minimised. Indeed, preferably, each increased wall-thickness portion of the bladder wall is surrounded by a portion not having the increased wall thickness.

In particularly preferred embodiments, each increased wall-thickness portion projects from an inner surface of the bladder wall towards the centre of the inflatable interior of the ball. This prevents the increased wall-thickness portions from affecting the external shape or appearance of the inflated ball. While preferred, the increased wall-thickness portions could project outwards, or could project both inwards and outwards, in which case a suitable cover may need to be provided to cover or disguise the projections.

Preferably, the wall thickness of the increased wall-thickness portions is no more than five times the wall thickness of the thinnest part of the bladder wall, preferably no more than four times the thickness, even more preferably no more than three times the thickness, most preferably no more than twice the thickness of the thinnest part of the bladder wall. Alternatively, there may be localised regions of decreased thickness, in which case the wall thickness of the increased wall-thickness portions may be no more than five times the median wall thickness or the substantially constant wall thickness of the majority area of the bladder wall, preferably no more than four times the thickness, even more preferably no more than three times the thickness, most preferably no more than twice the median wall thickness or the substantially constant wall thickness of the majority area of the bladder wall.

Particularly (but not exclusively) where the balancing mass elements are formed integrally with the bladder wall, preferably there are at least 10 balancing mass elements, more preferably at least 15 balancing mass elements, most preferably at least 20 balancing mass elements. It will be appreciated that, in cases where the balancing mass elements are formed integrally with the bladder wall, they are nonetheless considered discrete balancing mass elements where they are separate projections separated from one another by bladder wall having the standard bladder wall thickness.

It will generally be preferred for any devices, including all electronic devices, to be applied at one location in the ball. Therefore, preferably, the at least one device balanced by the distributed balancing mass is mounted at a substantially single point on or over the bladder wall. This simplifies the balancing arrangement and simplifies manufacture. While preferred, the present technique can be extended to balance devices located in multiple positions on or over the bladder wall. Indeed, as indicated above, this can be done by balancing with respect to the centre of mass of several devices at different positions.

In some embodiments, it may be preferable to provide multiple devices at different positions in the ball. One approach is for the first device to be provided at a first vertex of a substantially regular tetrahedron, a second device (preferably having substantially the same mass as the first device) to be provided at a second vertex of a substantially regular tetrahedron, and for the one or more balancing mass elements to be arranged substantially at or substantially evenly distributed by mass with respect to two other vertices of the substantially regular tetrahedron.

Another approach may be to balance multiple devices, or multiple sets of devices, separately. In particular, the at least one device may be a first device or first set of devices, and the ball may further comprise a second device or second set of devices mounted on or over the bladder wall such that a centre of mass of the second device or second set of devices is located away from a centre of the inflatable interior of the ball, the centre of mass of the second device or second set of devices defining a third point on the bladder wall coincident with or closest to the centre of mass of the second device or second set of devices and a fourth point on the bladder wall opposite the third point; and a second distributed balancing mass for at least partially rotationally balancing the mass of the second device or second set of devices, the distributed balancing mass comprising one or more balancing mass elements on or over the bladder wall, the one or more balancing mass elements being arranged at a plurality of locations spaced around the fourth point on the bladder wall and closer to the fourth point than the third point, and wherein the second distributed balancing mass comprises one of: c) at least four balancing mass elements, the balancing mass elements being arranged substantially at or substantially evenly distributed by mass with respect to each of at least four balancing points equally spaced around the fourth point and closer to the fourth point than the third point; or d) one or more mass balancing elements arranged on or over the bladder wall along one or more tracks along the bladder wall defining substantially all or one or more parts of the circumference of a circle or an ellipse. Indeed, if one considers that one or more devices (the first device or first set) may be balanced by the techniques described above, the result may be a ball that is balanced essentially identically to a ball without the devices or balancing masses. Therefore, the second device or second set of devices, may be assessed and balanced entirely separately from the first device or first set. This approach may be preferred when the multiple devices are spaced relatively far apart, but be used for any spacing of the device sets. It will be noted that preferably the second device or second set of devices comprises at least one electronic device. Any of the balancing approaches used above for the one or more devices (referred to in the present context as the first device or the first set of devices) may be used for the second device or second set of devices, including those of comparative examples. In particular, the second distributed balancing mass may comprise one or more balancing mass elements arranged substantially at or substantially evenly distributed by mass with respect to each of at least two balancing points equally spaced around the fourth point, preferably at least three balancing points equally spaced around the fourth point. The second distributed balancing mass could also comprise one or more balancing mass elements arranged substantially at or substantially evenly distributed by mass with respect to each of at least three balancing points spaced around the fourth point, the three balancing points together with the third point and/or the centre of mass of the of the second device or second set of devices defining four vertices of a substantially regular tetrahedron. The second distributed balancing mass could also comprise at least six balancing mass elements arranged substantially in a single plane, wherein each balancing mass element has two corresponding balancing mass elements which, together with the third point and/or the centre of mass of the of the second device or second set of devices, define four vertices of a substantially regular tetrahedron. Alternatively, the second distributed balancing mass may comprise one or more mass balancing elements arranged along one or more tracks along the bladder wall defining all or part(s) of the circumference of a circle or an ellipse, wherein preferably the third point lies perpendicular to the plane of the circle or the ellipse from the centre of the circle or the ellipse.

In all embodiments, preferably each device being balanced comprises an electronic device, although other devices that contribute to the mass of the ball could also be balanced in this way. Preferably, the or each electronic device comprises one or more of: a battery, a wireless charging module, an accelerometer, a gyroscope, a pressure sensor, a magnetometer, a pressure transducer and a location tracking device, such as an ultra-wideband transmitter and/or receiver.

Generally, it is preferred that the present technique is not used to balance the mass of the bladder valve. This is because this mass is generally not balanced in regular sports balls, and so athletes are generally accustomed to and indeed expect the effect of the bladder valve. An advantage of the present balancing technique, applied to balance only devices, such as electronic devices, other than the valve, is that the resulting ball may behave substantially identically to a conventional ball, including any effect from the valve. Therefore, preferably the bladder further comprises a valve for inflating the inflatable interior of the ball, wherein the valve is not one the devices balanced by the distributed balancing mass.

The present technique is most advantageous in application to spherical balls, which generally do not have much if any of a preferred rotation axis. Therefore, preferably, the bladder defines a substantially spherical inflatable interior of the ball. While this is preferable, the present technique can also be applied to other ball shapes, such as prolate spheroid shapes.

Preferably, the inflatable ball is an inflatable sports ball, preferably a soccer ball, basketball, netball, volleyball, or handball. However, other ball types may also be used.

In accordance with a second aspect of the invention, there is provided a method of manufacturing an inflatable ball, the method comprising: providing a bladder having a bladder wall defining an inflatable interior of the ball; providing at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and providing a distributed balancing mass for at least partially rotationally balancing the mass of the at least one device, the distributed balancing mass comprising one or more balancing mass elements provided on or over the bladder wall, the one or more balancing mass elements being arranged at a plurality of locations spaced around the second point on the bladder wall and closer to the second point than the first point, wherein the distributed balancing mass comprises one of: a) at least four balancing mass elements, the balancing mass elements being arranged substantially at or substantially evenly distributed by mass with respect to each of at least four balancing points equally spaced around the second point and closer to the second point than the first point; or b) one or more mass balancing elements arranged on or over the bladder wall along one or more tracks along the bladder wall defining substantially all or one or more parts of the circumference of a circle or an ellipse.

The method according to this aspect corresponds to a method of manufacturing an inflatable ball according to the first aspect, and so each of the preferred features and advantages discussed above applies equally to the method of this aspect of the invention.

In some embodiments, providing the distributed balancing mass comprises attaching one or more continuous strips or patches, preferably adhesive strips or patches, on or over the bladder wall. As mentioned above, this may take place in a step after inflation of the bladder.

In other embodiments, providing the bladder comprises moulding the bladder, and providing the distributed balancing mass comprises moulding one or more balancing mass elements integrally with the bladder wall when moulding the bladder. Moulding one or more balancing mass elements integrally with the bladder wall when moulding the bladder may comprise moulding a plurality of increased wall-thickness portions of the bladder wall. These increased wall-thickness portions are the same as described above.

BRIEF DESCRIPTION OF DRAWINGS

The invention will now be discussed with reference to the accompanying drawings, of which.

DETAILED DESCRIPTION

Figure 1:
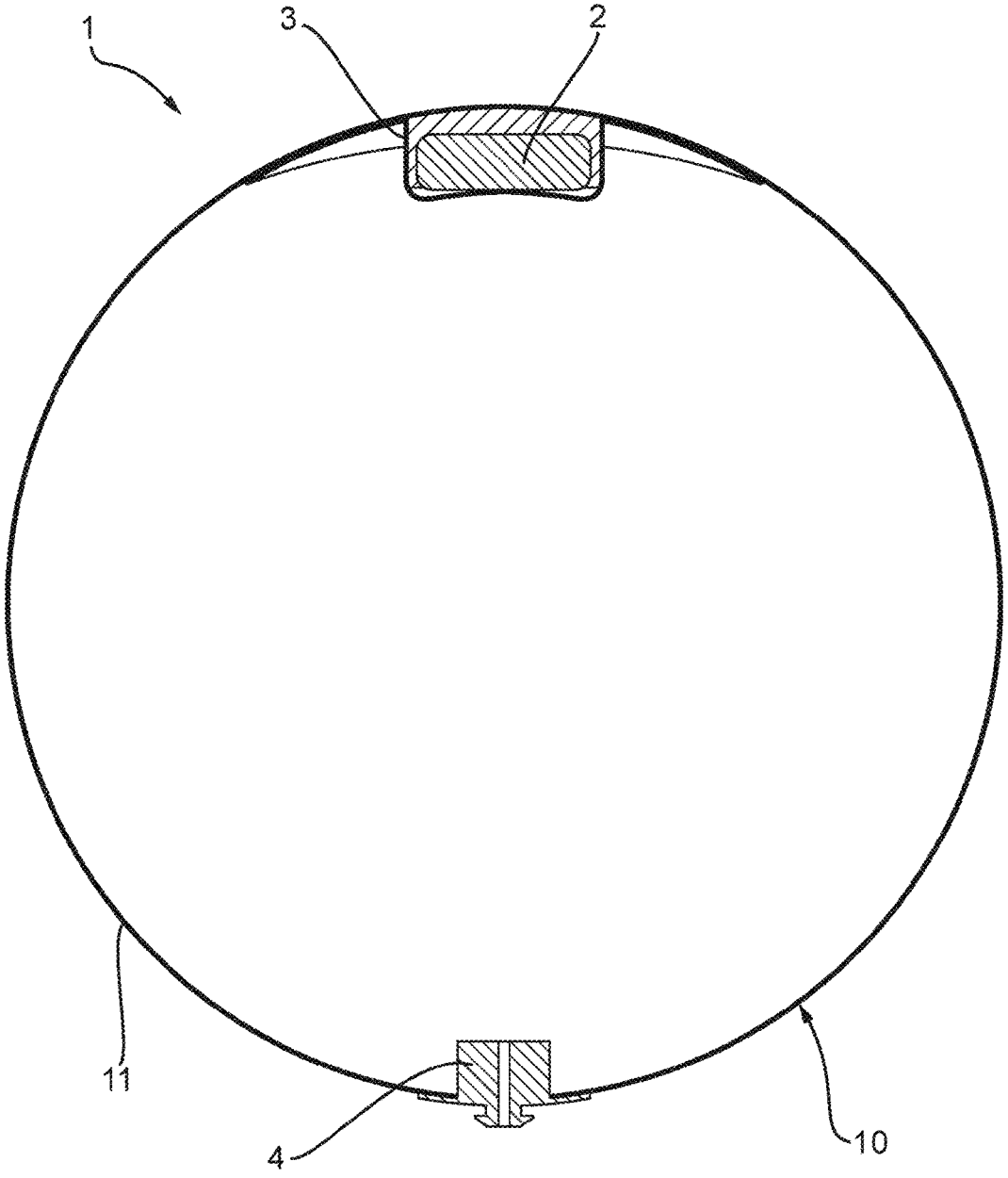
FIG. 1 is a schematic cross-section of a first example of an inflatable ball.

FIG. 1 shows a first example of a ball 1 in need of balancing in accordance with the present invention. The ball comprises a bladder 10 comprising a bladder wall 11, which defines a spherical inflatable interior of the ball. The bladder wall 11 is continuous except for a circular opening, at which a valve 4 is bonded to the bladder wall 11 to make the interior of the bladder airtight and to allow for the bladder to be inflated via the valve 4. Inside the ball is an electronic device 2. The electronic device 2 is contained in a housing 3 (which may also be considered a device within the meaning of this disclosure), which is adhered to an inner surface of the bladder wall 11. The electronic device may comprise one or more of a battery, a wireless charging module, an accelerometer, a gyroscope, a pressure sensor, a magnetometer, a force transducer and a location tracking device, such as an ultra-wideband transmitter and/or receiver. The electronic device and housing may have a mass of, for example, 15 grams. By its position adjacent to the inner surface of the bladder wall 11, the electronic device causes the ball to have a different centre of gravity than a ball without the electronic device. In order that balls without electronic devices feel substantially the same to a user, the mass of the electronic device and housing need to be balanced.

As will now be described with respect to FIGS. 2A to 8B, the present invention uses a distributed balancing mass 12 comprising one or more mass elements 13 to balance the mass of the electronic device 2 and housing 3.

To maintain the rotational balance of the ball, as it was before the introduction of electronics 2, the electronics and the distributed balancing mass 12 should not contribute any unbalanced forces or moments when the ball is spinning about any axis.

To achieve this, it is preferable that two criteria are substantially met. Assume there is a ball with initial centre of mass centred at the origin. Then let there be N masses introduced. Let the i'th mass have position vector $\vec{P}_i$ and mass $m_i$. The ball will be statically balanced, and the dynamic centrifugal forces will sum to zero if the centre of gravity of the electronics and the added masses coincide with the ball's original centre of mass. By the earlier statement this must be the origin, therefore:

$$\sum_{i=1}^{N} m_i \vec{P}_i = \vec{0} \tag{1}$$

The second criterion relates to ensuring there are no unbalanced moments when the ball is rotated about any axis. The definition of the inertia tensor for rigid body rotation with point masses is:

$$I = \sum_{i=1}^{N} m_i \left[ |P_i|^2 I(3) - \vec{P}_i \vec{P}_i^T \right] \tag{2}$$

It can be shown there will be no unbalanced moments if the second term in Equation (2) satisfies the following condition:

$$\sum_{i=1}^{N} m_i \vec{P}_i \vec{P}_i^T = \begin{bmatrix} \sum m_i x_i^2 & \sum m_i x_i y_i & \sum m_i x_i z_i \\ \sum m_i y_i x_i & \sum m_i y_i^2 & \sum m_i y_i z_i \\ \sum m_i z_i x_i & \sum m_i z_i y_i & \sum m_i z_i^2 \end{bmatrix} = \alpha \begin{bmatrix} 1 & 0 & 0 \\ 0 & 1 & 0 \\ 0 & 0 & 1 \end{bmatrix} = \alpha I(3) \tag{3}$$

The above condition says, firstly, that the added masses and their positions must be such that the products of inertia are all zero, and secondly, that the principal moments of inertia are all equal.

Several embodiments of balancing a sports ball will now be described, which either fulfil the above criteria, i.e. the centre of gravity of the electronics and the added masses coincide with the centre of mass of the ball and the principal moments of inertia are all equal, or which are closer to these criteria than many other conventional balancing methods.

Figure 2A:
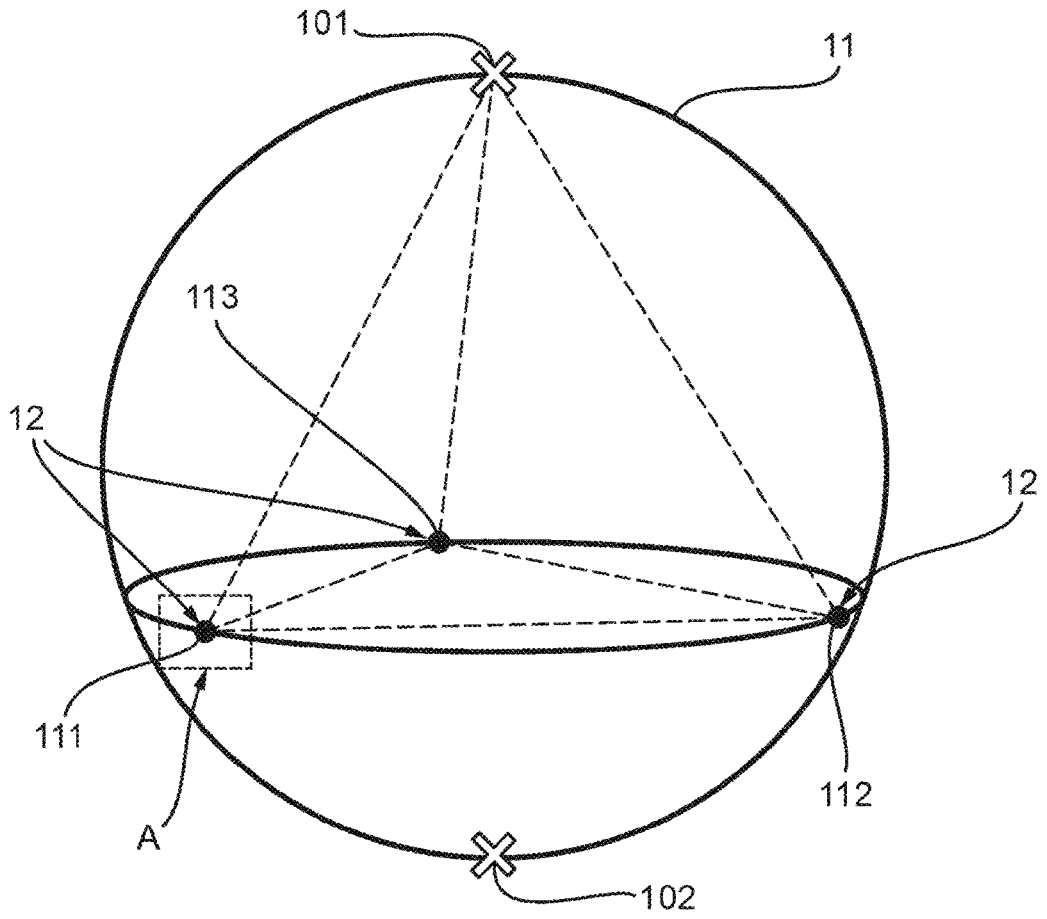
FIG. 2A schematically illustrates a balancing arrangement for the inflatable ball of FIG. 1.
Figure 2B:
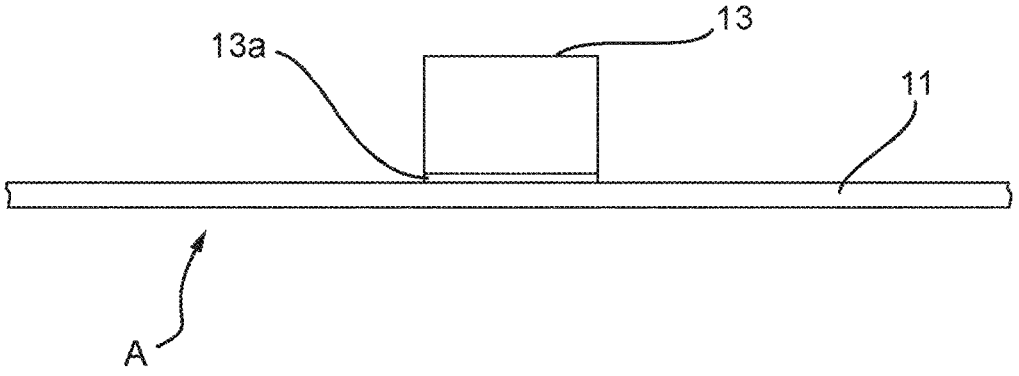
FIG. 2B is an enlarged view of the distributed balancing mass in region A.

When one considers dynamically balancing a sports ball, the fewest masses is often the most desirable solution and the above criteria can be fulfilled with the fewest masses by using a tetrahedral balancing method, which is demonstrated in FIGS. 2A and 2B.

FIG. 2A shows a tetrahedral balancing arrangement of the spherical ball shown in FIG. 1. In this example, the centre of mass of the electronic device 2 and the housing 3 is substantially coincident with the first point 101 on the bladder, which in the Figure is the uppermost point of the bladder wall 11. Opposite the first point 101 is a second point 102. The first point 101 is treated as the first vertex in a regular tetrahedron whose other three vertices 111, 112, 113 also coincide with the bladder wall 11. In other words, the regular tetrahedron that is circumscribed by the sphere of the bladder wall. The other three vertices of this regular tetrahedron, which are referred to herein as balancing points, define the preferred locations of three balancing masses for offsetting the balance of the electronic device 2 and its housing 3. As shown in FIG. 2A, a straight line along the bladder wall passing through these three balancing points 111, 112, 113 defines a circle. The first and second points 101, 102 are both perpendicularly offset from the plane of this circle from the centre point of this circle. This plane, and all three balancing points 111, 112, 113 are closer to the second point 102 that the first point 101.

The balancing masses located at the three balancing points 111, 112, 113 are collectively referred to as a distributed balancing mass 12. FIG. 2B shows an enlarged region A of FIG. 2A in cross-section and illustrates one balancing mass element 13 of the distributed balancing mass 12. FIG. 2B shows the bladder wall 11 as flat for simplicity, but it will be appreciated that the inner surface of the bladder wall is concave in practice. In this example, the balancing mass element 13 is a block of rubber that has been moulded to have the correct size and shape, i.e. suitable for adhering to the concave inner surface of the bladder wall 11, and is adhered to the inside of the bladder wall 11 by and adhesive 13*a*. To prepare the inner surface of the bladder and the balancing mass elements for adhesion, the bonding surfaces should be sanded and cleaned with a suitable solvent. The adhesive 13*a*, which should be a contact adhesive, should be applied to the clean surfaces and left for ten minutes. A second application of the contact adhesive should be performed, left for ten minutes, and then the bonding surfaces pressed together and allowed to cure for 24 hours. Each balancing point 111, 112, 113 is provided with a corresponding balancing mass element 13 in the manner illustrated in FIG. 2B and as described above. If the electronic device 2 and the housing 3 have a combined mass of, for example, 15 grams, then each balancing mass element 13 at each balancing point 111, 112, 113 should have a mass of approximately 15 grams, such that the total mass of the distributed balancing mass is three times that of the electronic device 2 and the housing 3. It will be noted that the mass of the valve is not taken into account here. This choice is made since it is generally desired for a ball with electronic devices to behave as similarly as possible to one without the electronic devices. It would, however, be possible to factor in the mass of the valve to achieve a ball whose total centre of mass is substantially at the centre.

Figure 2C:
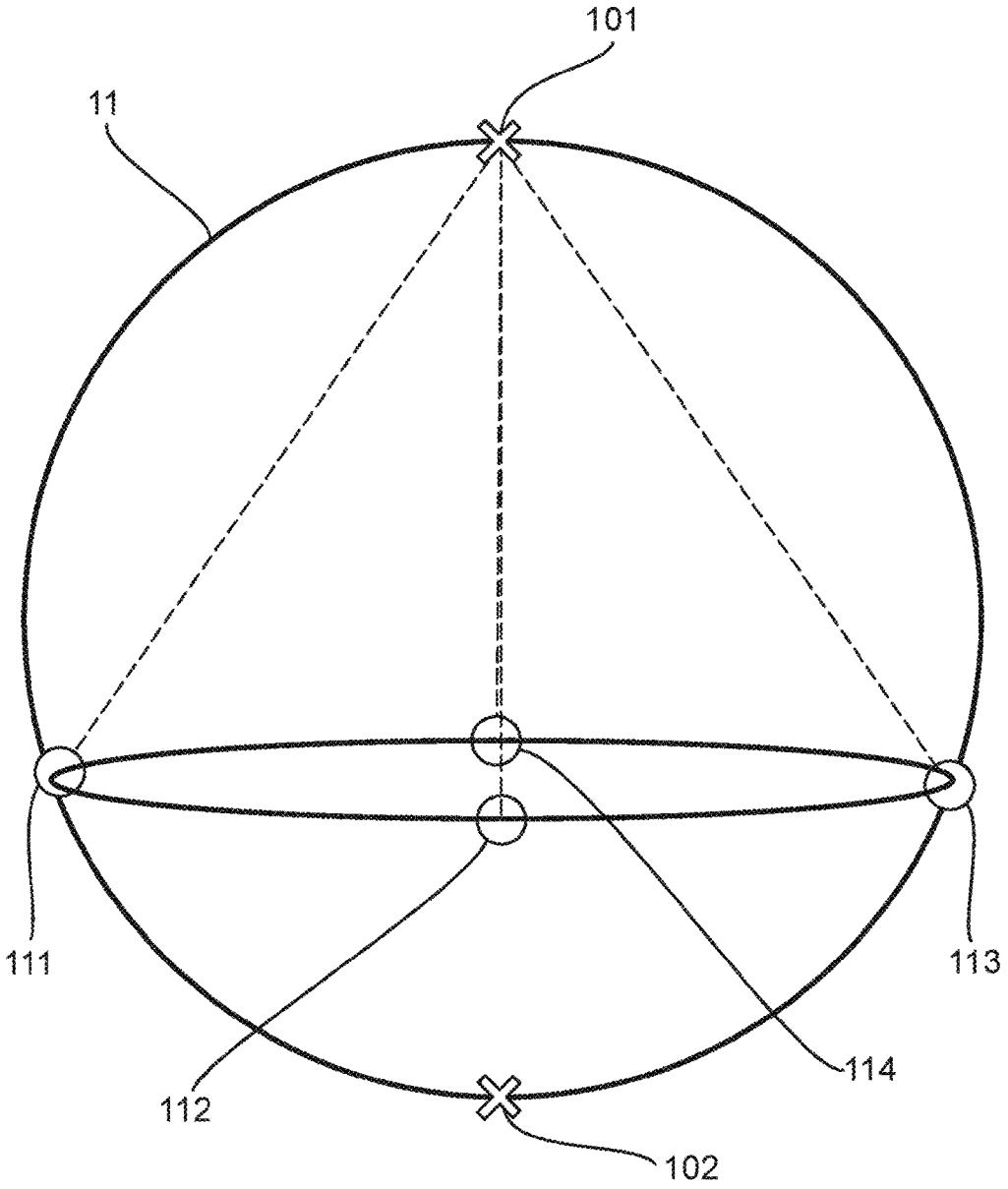
FIG. 2C illustrates a variant balancing arrangement.

While this tetrahedral arrangement can satisfy the criteria of the two equations set out above and may be considered the mathematically most efficient arrangement, this arrangement requires relatively large balancing mass elements 13 at each of the three balancing points 111, 112, 113. This can cause irregular bouncing of the ball, particularly when it bounces close to one of the balancing mass elements 13. An alternative arrangement is illustrated in FIG. 2C. Here, four balancing mass elements 13 are provided respectively at four balancing points 111, 112, 113, 114. These four balancing points 111, 112, 113, 114 are arranged in the same plane as the three balancing points 111, 112, 113 of FIG. 2A, and are equally spaced around the second point 102, such that the four balancing points 111, 112, 113, 114, together with the first point 101, describe a square based pyramid. By providing four balancing mass elements 13 instead of three, the mass of each may be reduced while still achieving a similar balancing effect to FIG. 2A. The reduction in mass of the balancing mass elements 13 helps to prevent irregular bouncing of the ball. It will be appreciated that this principle may be taken further to further reduce the mass of each balancing mass element. For example, five balancing mass elements may be arranged at five balancing points equally spaced around the second point 102. As each new balancing point is provided, the required mass of the balancing mass element is reduced, further reducing the impact of the balancing mass elements on the bouncing of the ball.

While the above tetrahedral arrangement can satisfy the criteria of the two equations set out above and may be considered the mathematically most efficient arrangement, and the square-based pyramid arrangement reduces the mass of each balancing mass element, applying three or more individual balancing mass elements is a time-consuming and labour-intensive process. Therefore, several alternative solutions for achieving substantial balancing of the ball, in line with the above equations, that are more procedurally straightforward are also suggested and described with reference to FIGS. 3A to 8B.

Figure 3A:
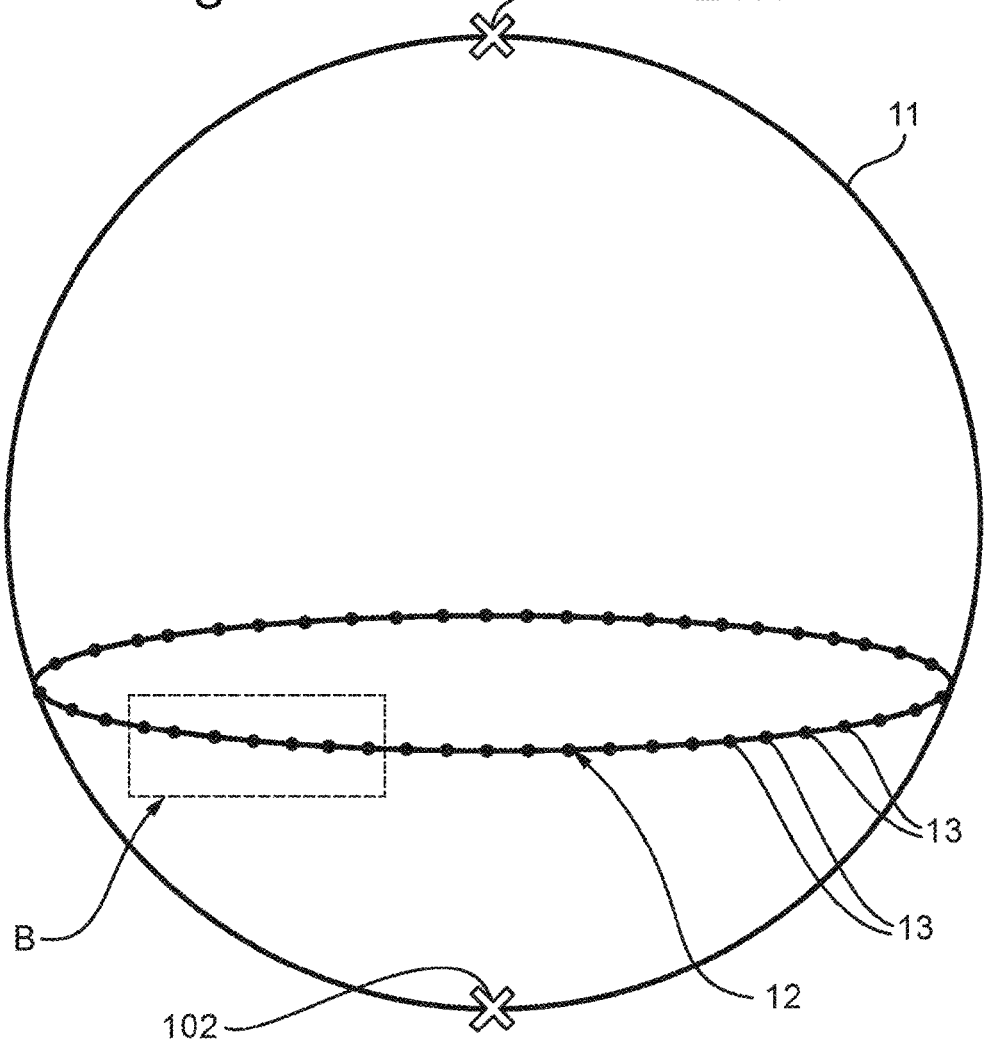
FIG. 3A schematically illustrates another balancing arrangement for the inflatable ball of FIG. 1, and FIGS. 3B and 3C are an enlarged views of the distributed balancing mass in region B.

FIG. 3A illustrates an alternative balancing arrangement for balancing the ball of FIG. 1. Instead of using three essentially point-masses on the vertices of the tetrahedron's base at the balancing points 111, 112, 113, the masses can be split into a much larger number of smaller point masses around the base of an inscribed cone. FIG. 2A showed a straight line along the bladder wall 11 passing through the three balancing points 111, 112, 113, defining a circle. Instead of providing a single mass element at each balancing point, the mass is distributed evenly along this line, as shown in FIG. 3A. The distributed mass element 12 is thus defined by a track of small mass elements 13 that defines the circumference of a circle. Now, each mass element 13 is much smaller than the three point masses provided at the balancing points 111, 112, 113 in the embodiment of FIG. 2A. These masses may now be of a size that they can produced by directly moulding the mass elements into the bladder wall 11, particularly by providing localised regions of increased bladder wall thickness.

Figure 3B:
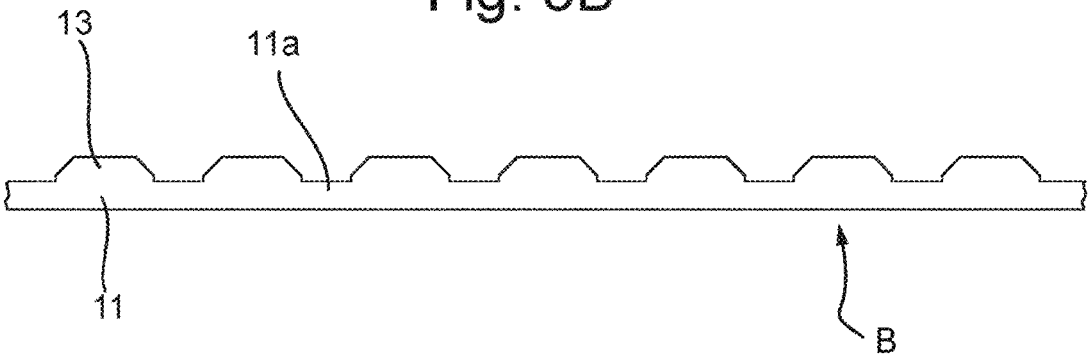
Figure 3C:
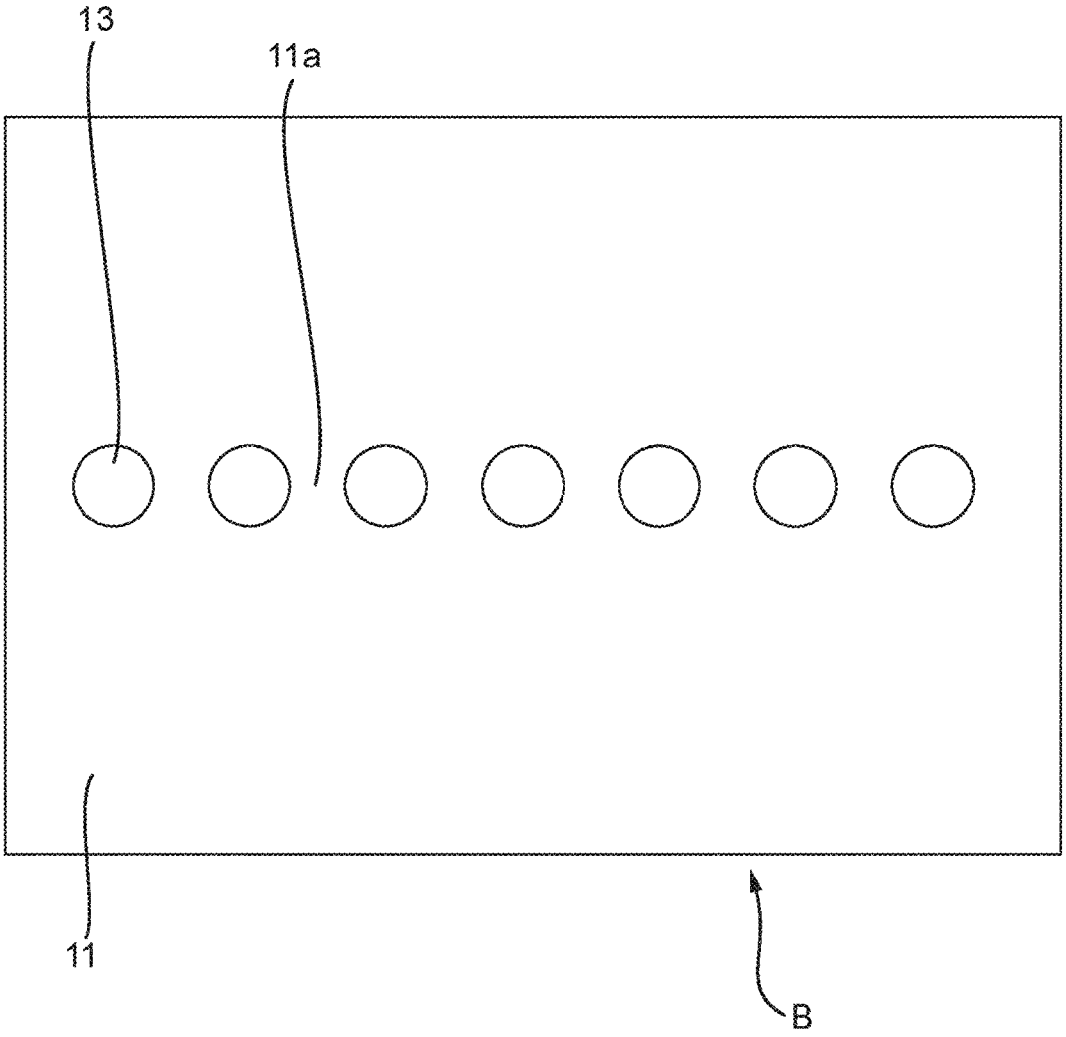

FIGS. 3B and 3C shows an enlarged region B of FIG. 3A in cross-section to illustrate these integrally moulded balancing mass elements 13. When the bladder mould is designed, a series of recesses are provided on the surface of the mould that will define the inner surface of the bladder. In the present arrangement a series of circular recesses are provided so that the inner surface of the bladder features a row of circular protrusions 13 as the integrally moulded balancing mass elements. These circular protrusions 13 are thus provided by regions of the bladder wall 11 having increased wall thickness as a result of the recesses in the moulding tool used to mould the bladder wall. Each circular protrusion may have a thickness of approximately twice that of the surrounding bladder wall thickness. Each circular protrusion may have a diameter of no more than 0.5 cm and may be separated from one another by an intervening bladder wall portion 11*a* that does not have the increased wall thickness. As a result, when the bladder is inflated, the bladder is still able to expand without any significant restriction that would be caused by large areas of increased wall thickness. As with the above embodiment, the circular protrusions, which act as the balancing mass elements 13, may have a mass of three times that of the electronic device 2 and the housing 3.

Figure 4:
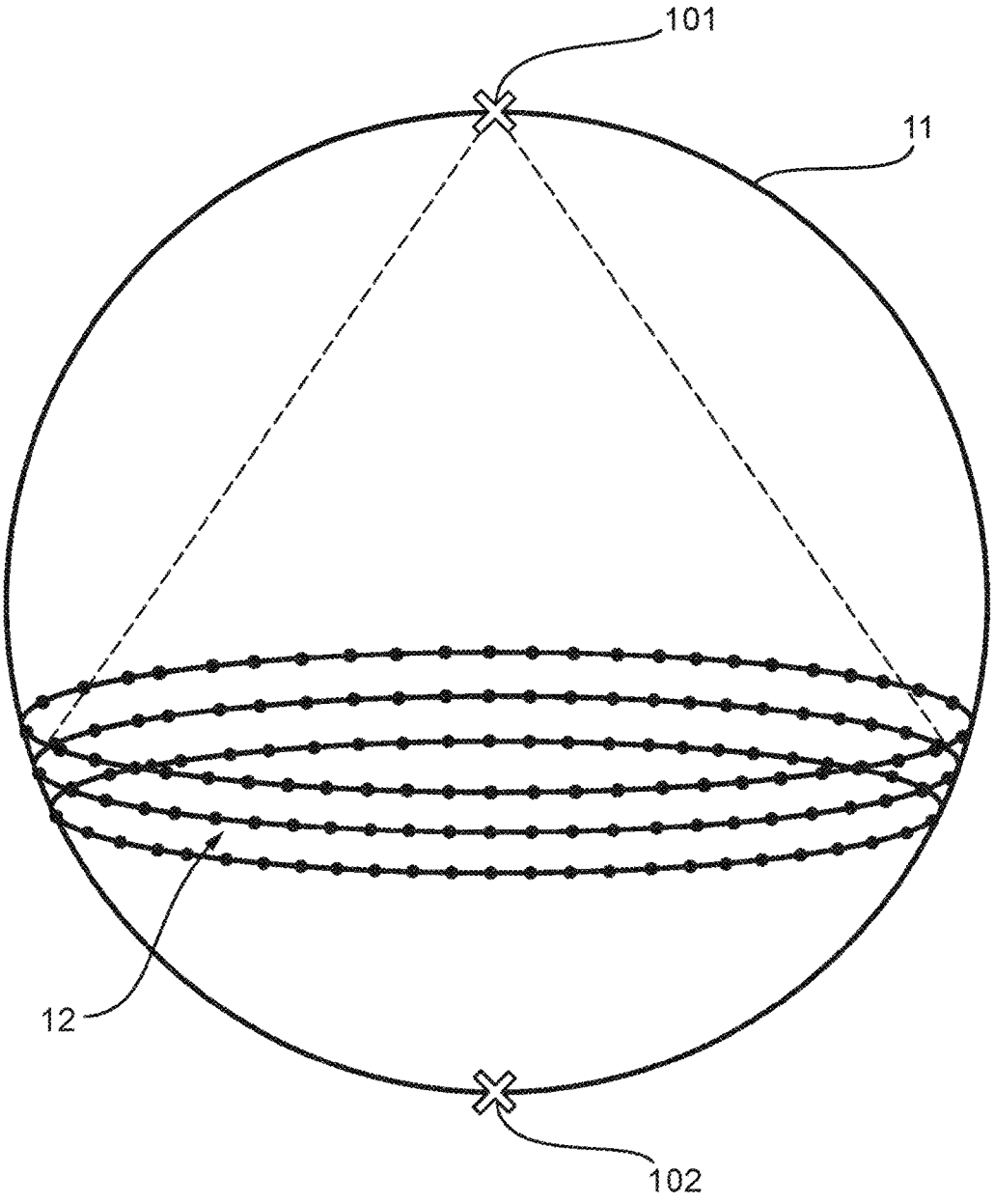
FIG. 4 schematically illustrates another balancing arrangement for the inflatable ball of FIG. 1.

In some cases, particularly where the electronic device 2 and the housing 3 is especially heavy, it may not be possible to balance the mass with a single row of integrally moulded balancing mass elements 13 while still having them small enough and spacing them far apart enough to allow acceptable inflation of the bladder. FIG. 4 shows an alternative embodiment in which three parallel tracks of integrally moulded balancing mass elements 13 are provided, each one defining the circumference of a circle to which the first point 101 is perpendicularly offset from a centre point of that circle. Each integrally moulded balancing mass element is nonetheless closer to the second point 102 (opposite the first point) than the first point 101. The balancing mass elements 13 are nonetheless formed in the same manner as those described with reference to FIG. 3. Again, the total mass of all balancing mass elements 13 may be substantially three times the mass of the electronic device 2 and the housing 3.

Figure 5A:
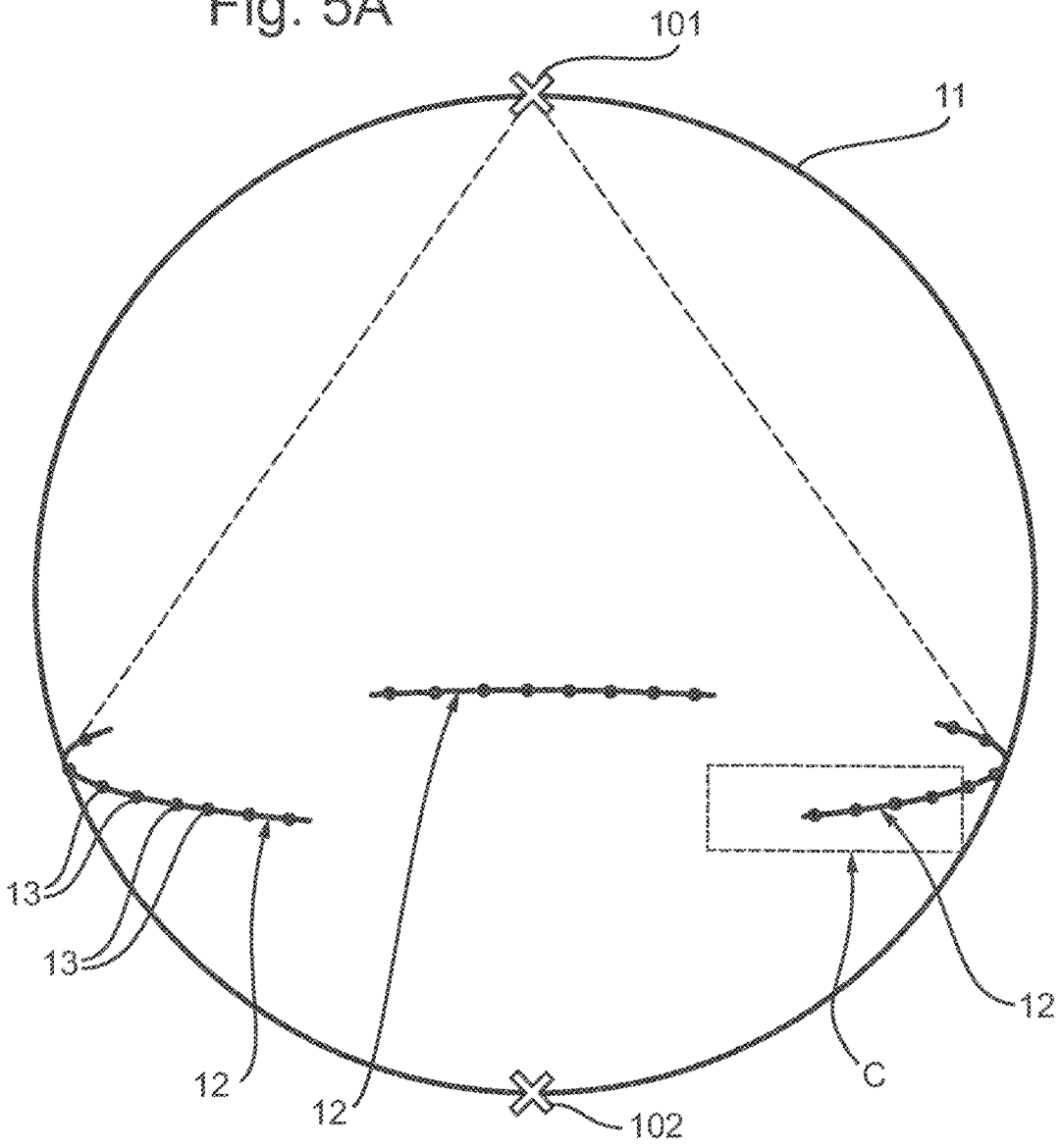
FIG. 5A schematically illustrates another balancing arrangement for the inflatable ball of FIG. 1
Figure 5B:
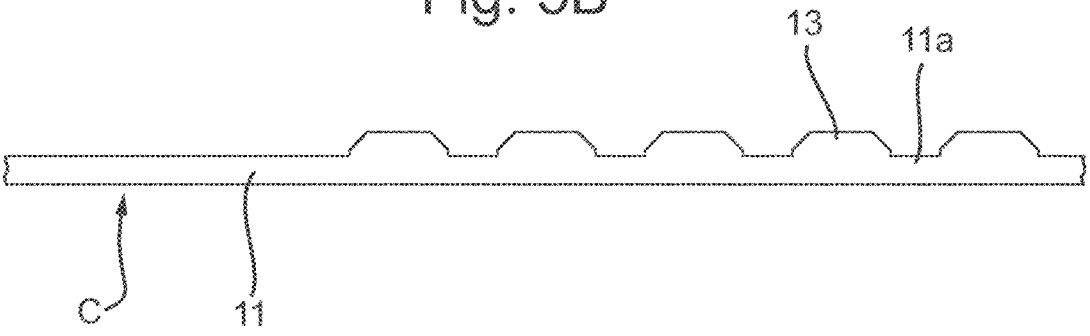
FIG. 5B is an enlarged view of the distributed balancing mass in region C.

FIGS. 5A and 5B illustrate another variant using integrally moulded balancing masses arranged along tracks along the inner surface of the bladder wall 11. In this embodiment, rather than extending along the entire circumference of a circle, the integrally moulded balancing masses 13 arranged along three tracks that define an arc corresponding to part of the circumference of that circle. Each arc is of the same length and has the same number of integrally moulded balancing masses 13. The three tracks are evenly spaced apart. Accordingly, each track is effectively centred on one of the three balancing points 111, 112, 113 described with respect to FIG. 2A.

A downside to integrally moulded balancing elements 13 is that they need to have specialised moulding tools produced. Any changes to the design of the electronics module that changed the weight would require its own specially designed bladder. Also, the effect of integrally moulded balancing elements 13 on ball inflation can be minimised but not removed entirely. FIGS. 6A to 6E illustrate an embodiment that addresses these issues, while also removing the requirement in the context of the FIG. 2 arrangement to attach the masses inside the bladder during assembly of the bladder.

Figure 6A:
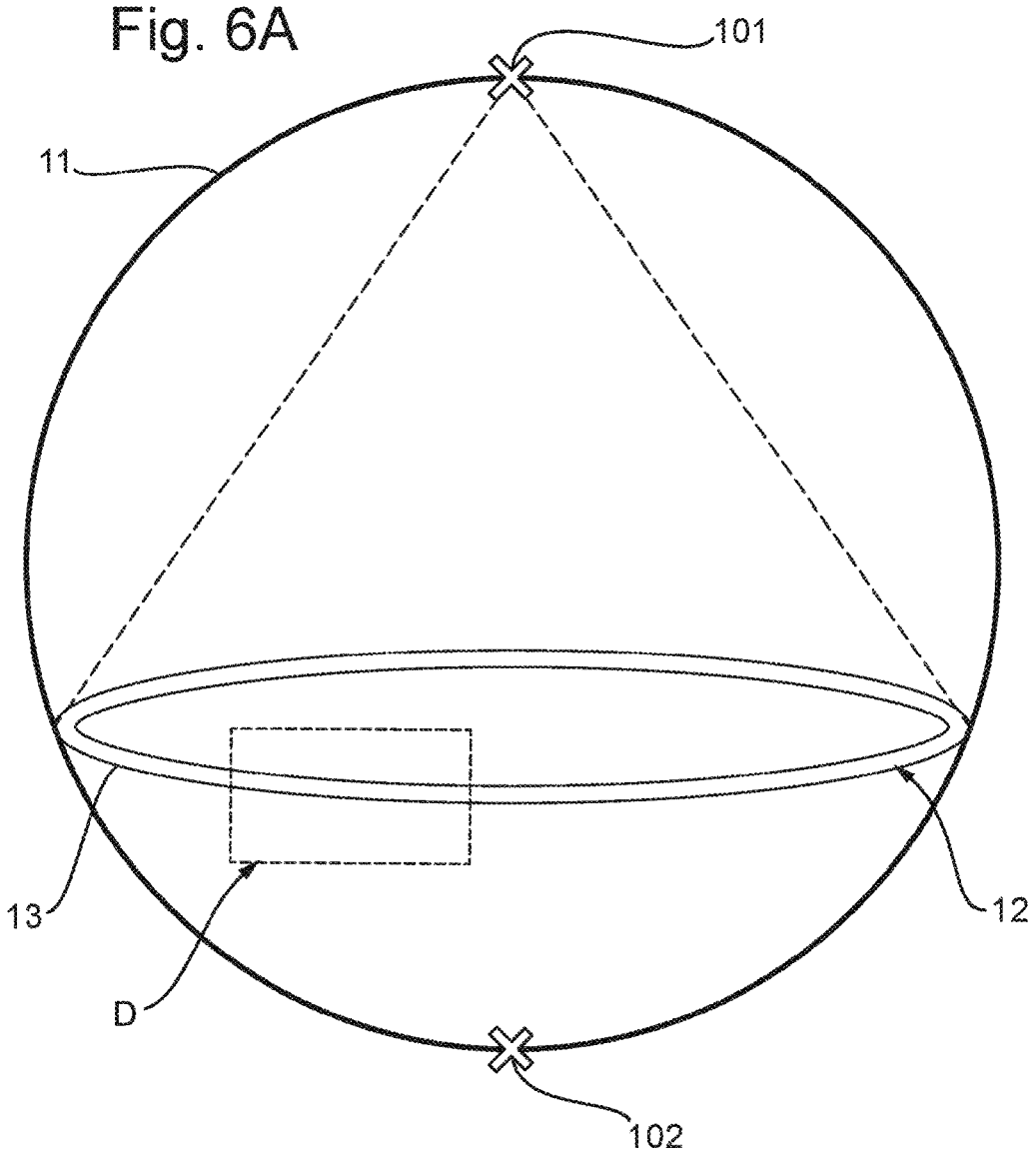
FIG. 6A schematically illustrates another balancing arrangement for the inflatable ball of FIG. 1.
Figure 6B:
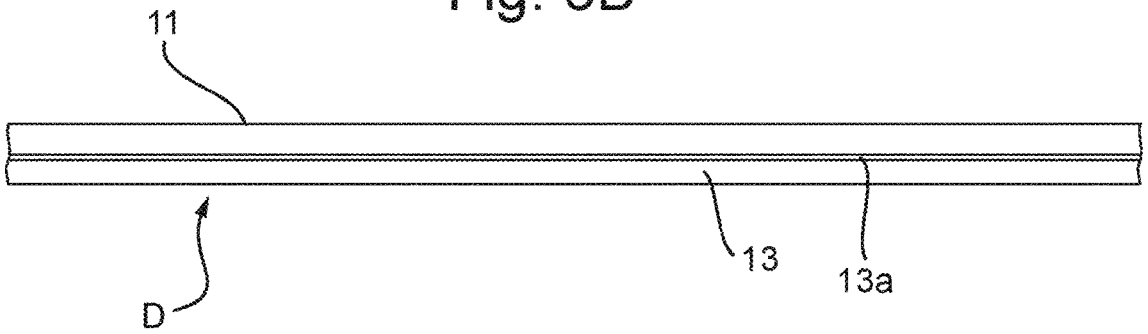
FIG. 6B is an enlarged view of a first variant of the distributed balancing mass in region D.

In the embodiment of FIGS. 6A and 6B, instead of being formed by integrally moulded balancing elements, the distributed balancing mass 12 is formed by a continuous strip 13 as the balancing mass element, which is applied to the bladder wall 11. The strip may be a rubber strip whose mass is approximately three times that of the electronics device 2 and housing 3. In this embodiment, the rubber strip is applied to the outside of the bladder using an adhesive 13*a* after inflation of the bladder. The rubber strip is applied along the same track defining the circumference of a circle that the integrally formed balancing mass elements of FIG. 3A were arranged on. Specifically, an equilateral triangle formed by three points along the circular track should form the vertices of a regular tetrahedron with the first point 101, which is substantially where the electronic device 2 is positioned.

Figure 6C:
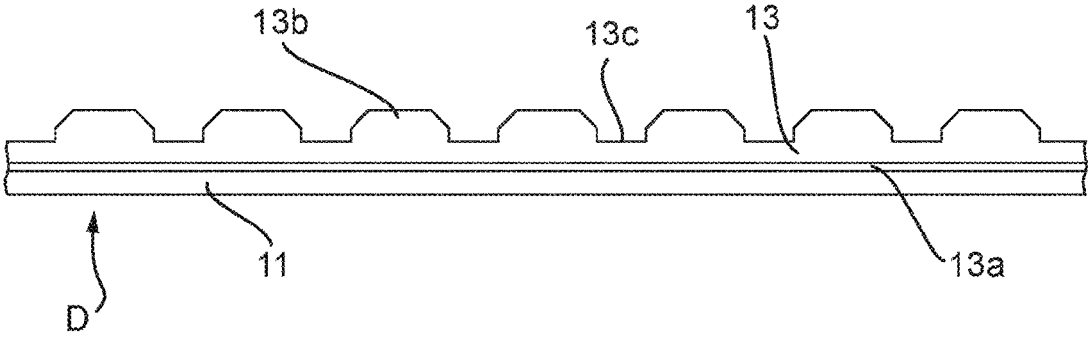
FIG. 6C is an enlarged view of a second variant of the distributed balancing mass in region D.

In the case of the strip shown in FIG. 6B, this is provided by a strip of substantially continuous thickness. This is particularly suitable for strips applied after the bladder has been assembled and inflated to a final size. However, the strip may cause problems if applied to the ball before it is fully inflated, since the thickness of the strip may inhibit the inflation of the ball. This prevents this type of strip being used effectively on the inner surface of the bladder wall. FIG. 6C shows an alternative form of strip 13. In the embodiment illustrated by FIG. 6C, the strip is adhered to an inner surface of the bladder wall 11 by an adhesive 13*a*, although it could also be used on the outside surface of the bladder wall. The strip comprises increased thickness portions 13*b* arranged along the strip and separated from one another by decreased thickness portions 13*c* of the strip. This arrangement is more clearly shown in FIG. 6E, which shows a strip in plan view. The purpose of the increased thickness portions 13*b* may be to contribute significantly to the mass of the strip. Each increased thickness portion 13*b* may have a thickness of 5 mm and may extend 1 cm along the length of the strip, for example. The purpose of the decreased thickness portions 13*c* may be to hold the increased thickness portions 13*b* together in one continuous strip to facilitate application while also being thin enough to allow the strip to stretch with the bladder as it is inflated. Each decreased thickness portion 13*c* may have a thickness of 1 mm and may extend 1 cm along the length of the strip, for example. Again, the strip may be formed of rubber.

Figure 6D:
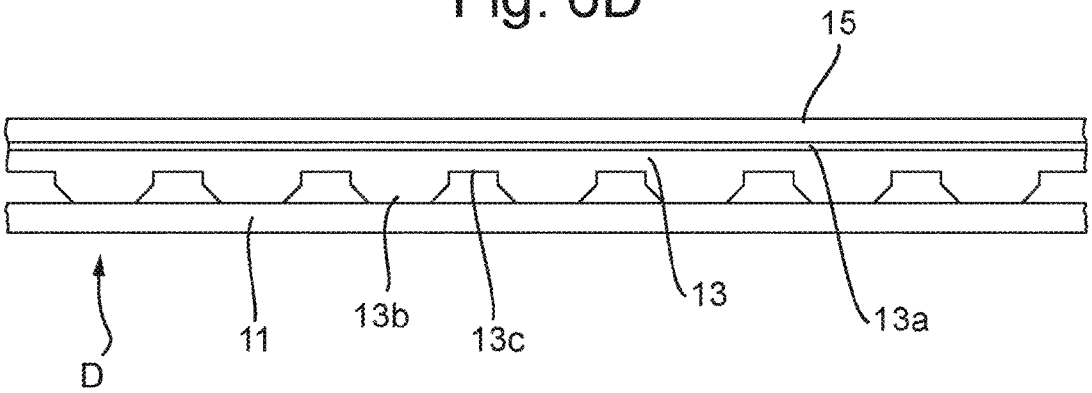
FIG. 6D is an enlarged view of a third variant of the distributed balancing mass in region D.

FIG. 6D shows an alternative arrangement in which the same strip from FIG. 6D is applied to an inner surface of a cover 15 of the inflatable ball. This cover may form the outermost layer of the ball and may be made of leather, synthetic leather, polyurethane or PVC, for example. Thus, the strip is arranged between the cover layer and the bladder. In this case, it may be desirable for the thickness of the increased thickness elements to be lower, e.g. less than 3 mm. The width of the strip may be increased to increase the overall mass of the strip. In this embodiment, the strip is adhered to the cover by an adhesive layer 13*a*.

Figure 6E:
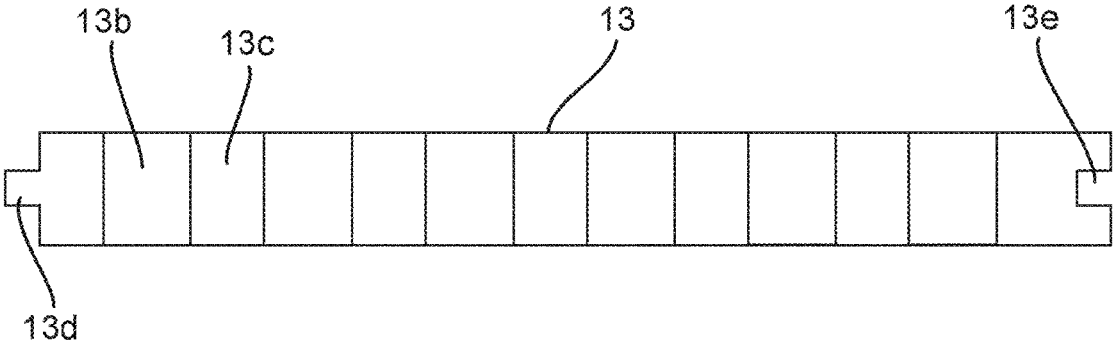
FIG. 6E is a schematic view of the distributed balancing mass used in FIGS. 6C and 6D.

It may be desirable to form the distributed balancing mass by multiple separate strips. This may allow, for example, different standardised strips of different weights to be used to precisely balance the exact mass of the electronics device in a particular ball. FIG. 6E shows a strip in plan view and shows that each strip may be provided with complementary shaped end edges that are configured to fit together. In particular, a first end edge of the strip is provided with a central projection 13*d*. The opposing end edge of the strip is provided with a central recess 13*e* arranged such that the central projection 13*d* of one strip fits into the central recess 13*e* of the adjacent strip to align the strips in a jigsaw-like manner. Of course, if one long strip is to be used, these complementary end edges may be used to line up the opposing end edges of the same strip after it has wrapped around the bladder.

While the embodiments of FIGS. 3A to 6B have all distributed the mass of the balancing mass elements 13 along tracks around the bladder wall, instead of having the essentially point masses of FIG. 2, two other examples for distributing the balancing mass are shown in FIGS. 7A to 8B. Each of these shows balancing mass elements distributed with respect to three balancing points as shown in FIG. 2A, but the same balancing mass elements could also be arranged with respect to four or more balancing points, as shown in FIG. 2C.

Figure 7A:
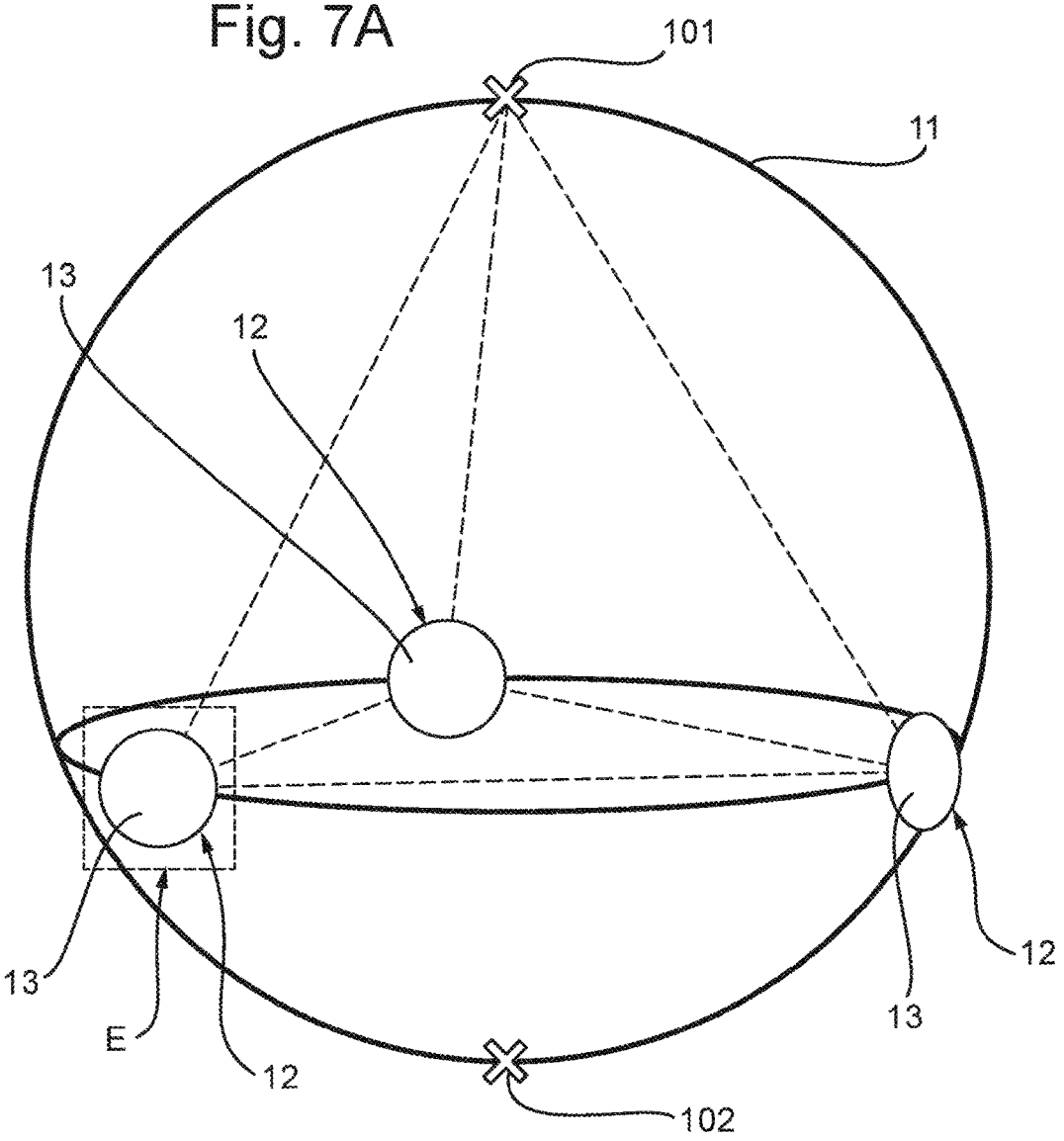
FIG. 7A schematically illustrates another balancing arrangement for the inflatable ball of FIG. 1
Figure 7B:
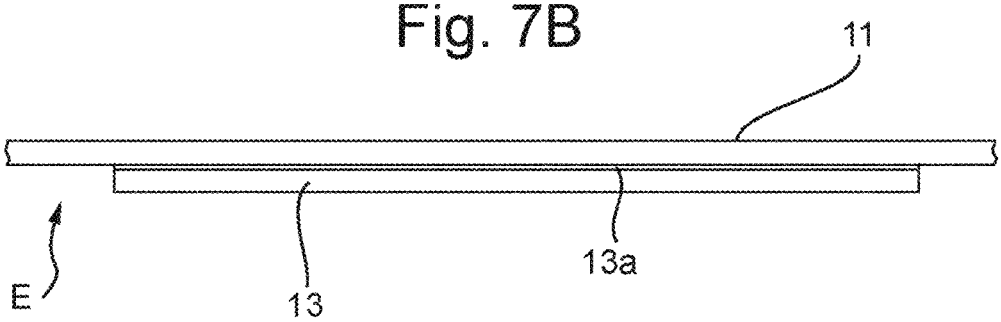
FIG. 7B is an enlarged view of the distributed balancing mass in region E.

FIGS. 7A and 7B show an example in which each balancing mass element 13 is formed by a relatively large patch. Like the strip of the previous embodiment, each patch 13 is applied to the outside of the bladder using an adhesive 13*a* after inflation of the bladder. Each patch may again be a patch of rubber or another thin flexible mass. Referring again to FIG. 2A, one patch is applied centred on each of the three balancing points 111, 112, 113. Each patch may have the same mass as the electronic device 2 and housing 3, but can be conveniently applied to the outer surface of the bladder after the bladder has been inflated due to their large area and hence low thickness. Alternatively, four patches could be applied to the four balancing points of FIG. 2C.

Figure 8A:
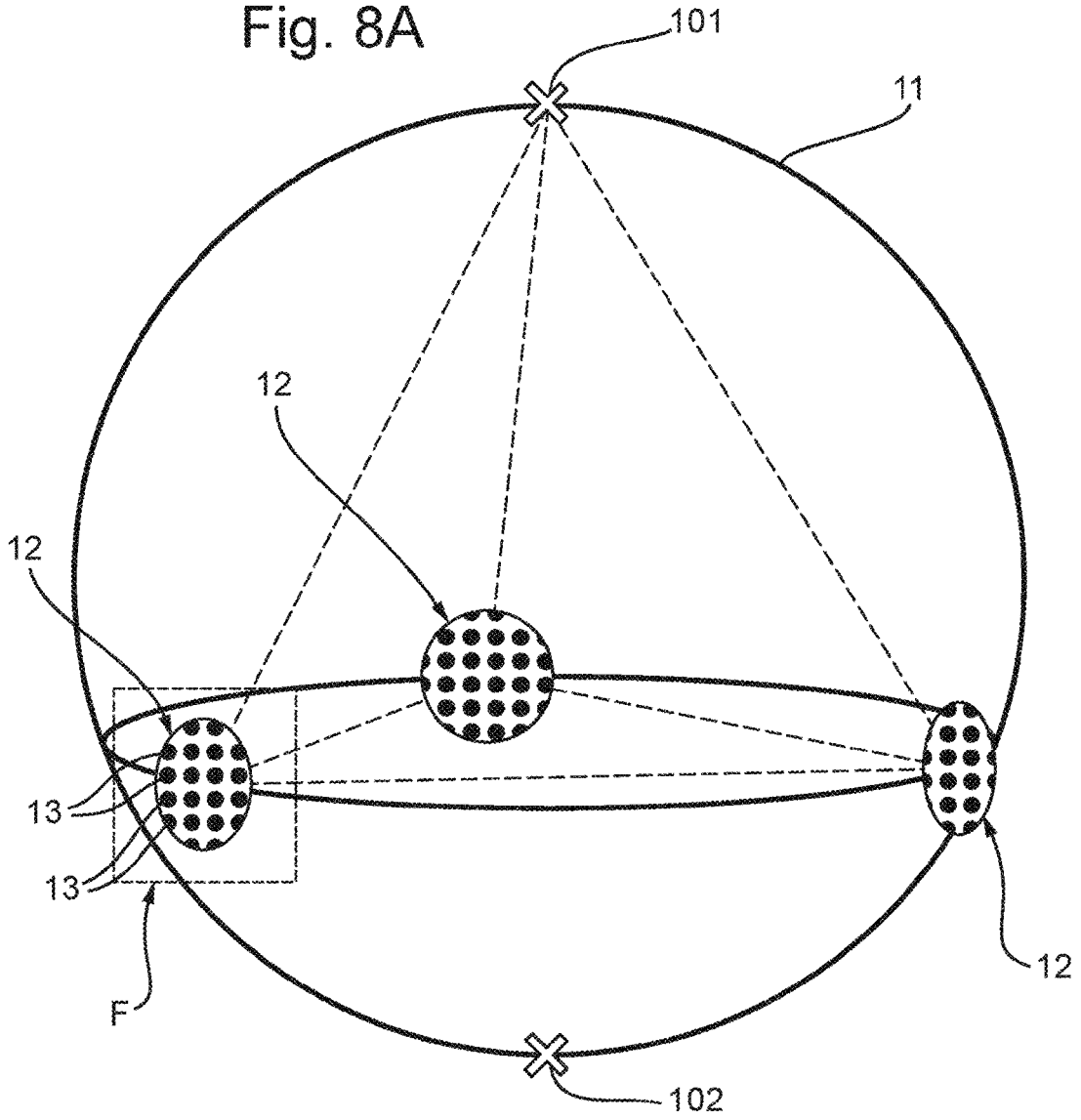
FIG. 8A schematically illustrates another balancing arrangement for the inflatable ball of FIG. 1
Figure 8B:
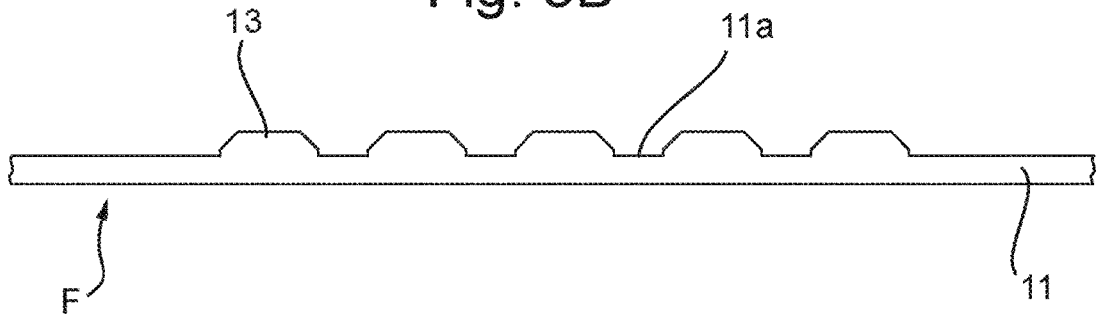
FIG. 8B is an enlarged view of the distributed balancing mass in region F.

FIGS. 8A and 8B show an embodiment which once again use balancing mass elements 13 that are integrally formed in an inner surface of the bladder wall 11. This embodiment differs the embodiments of FIGS. 3A to 5B in that the balancing mass elements 13 cover three circular regions of the bladder wall, each circular region being centred on one of the three balancing points 111, 112, 113 that were described with reference to FIG. 2A, although a circular region could alternatively be provided for each of the four balancing points of FIG. 2C. Within each circular region, the integrally formed balancing mass elements 13 are arranged in a two-dimensional array across the inner surface of the bladder. Again, each integrally formed balancing mass element 13 may be a circular region of increased wall thickness compared to the rest of the bladder wall 11. The integrally formed balancing mass elements 13 may once again be spaced from one another by intervening wall portions 11*a* that do not have the increased thickness, to minimise the effect these elements have on the inflation of the bladder.

The above embodiments have all dealt with a ball with additional mass introduced by an electronic device in one location around the periphery of the bladder. Techniques will now be described for embodiments in which additional mass is introduced by multiple electronic devices at different locations around the periphery of the bladder.

Figure 9:
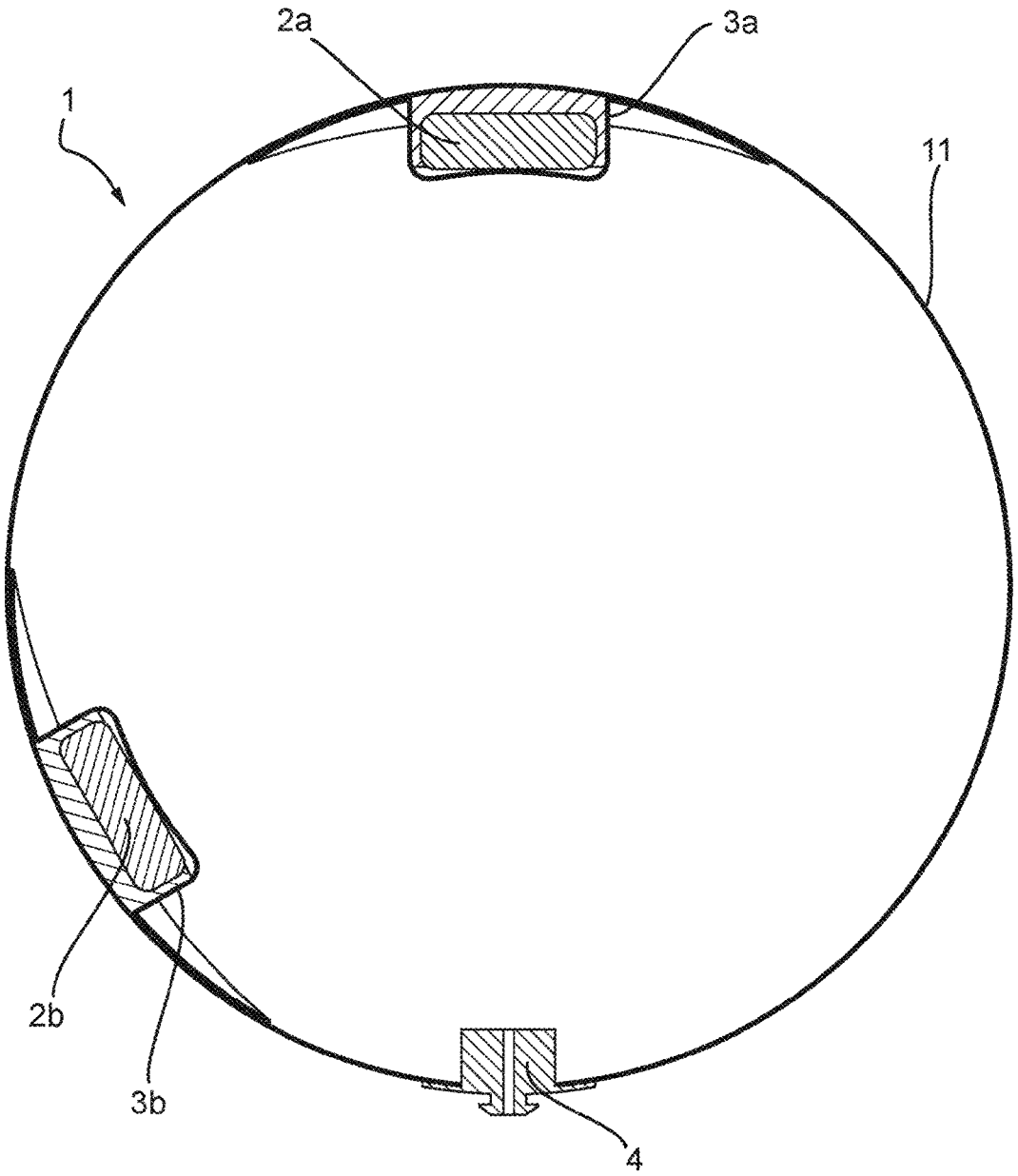
FIG. 9 is a schematic cross-section of a second example of an inflatable ball.
Figure 10:
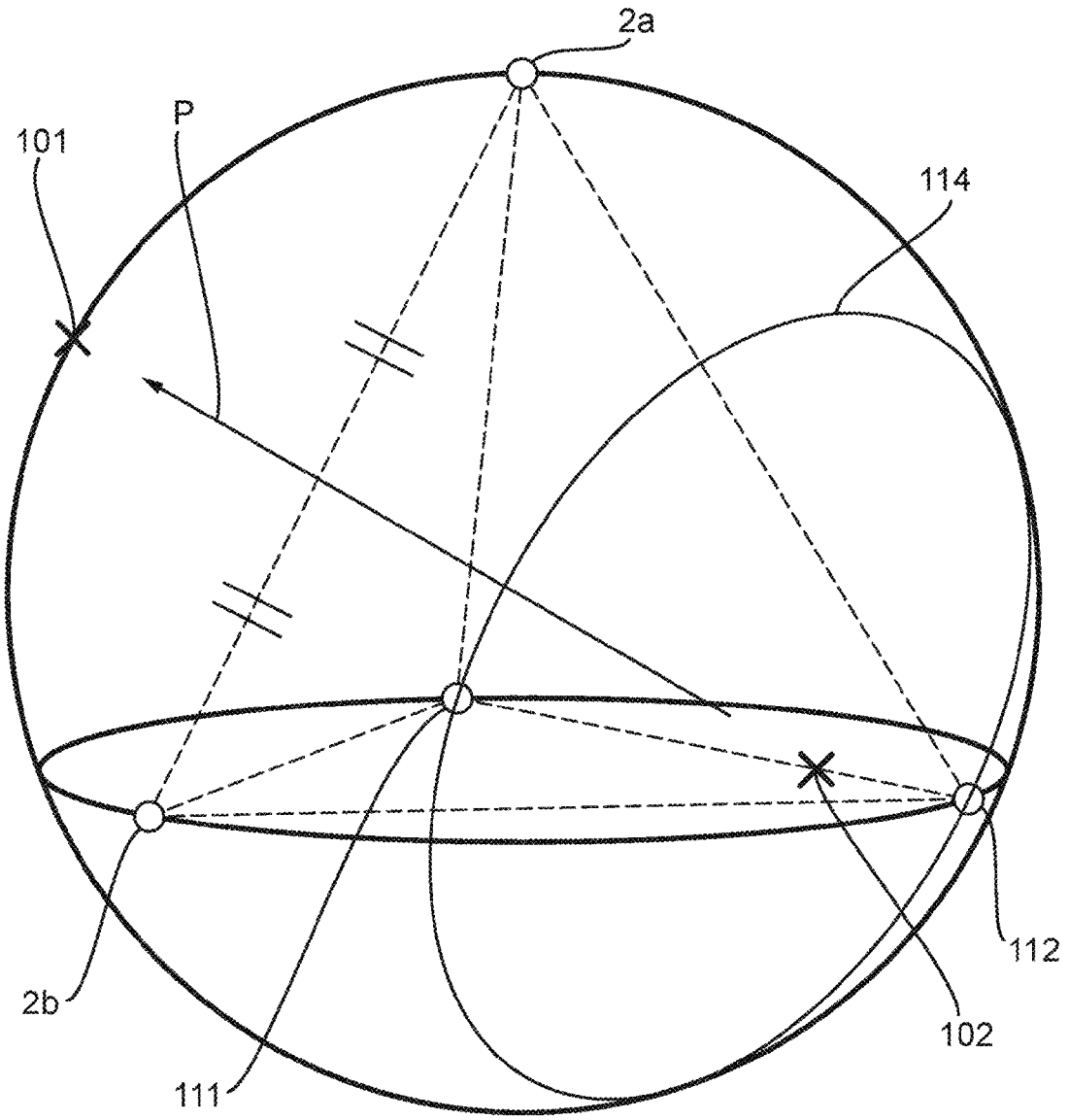
FIG. 10 schematically illustrates a balancing arrangement for the inflatable ball of FIG. 9.

FIG. 9 shows a ball 1 with a bladder 10 having bladder wall 11 and valve 4, as described above with respect to FIG. 1. A first electronic device 2*a* is provided in a first housing 3*a*, which is constructed and arranged identically to that described above with respect to FIG. 1. Additionally, this ball 1 comprises a second electronic device 2*b*. The second electronic device 2*b* is secured in a second housing 3*b*, which is adhered to an inner surface of the bladder wall. As shown in FIG. 10, the position of these two electronic devices has been selected so that they are at two of the four vertices of a regular tetrahedron circumscribed by the sphere of the bladder wall 11. It is assumed here that the electronic devices 2*a* and 2*b* have the same mass or that the housings 3*a*, 3*b* can be weighted so that the first electronic device 2*a* and first housing 3*a* have the same mass as the second electronic device 2*b* and second housing 3*b*.

According to this positioning of the electronic devices 2*a*, 2*b*, there are two options for balancing the mass of the electronic devices.

A first option is to provide two balancing masses at first and second balancing points 111, 112 corresponding to the other two vertices of this regular tetrahedron. This could be a point like balancing mass as described with reference to FIG. 2, a patch centred on each balancing point, as described with reference to FIG. 7, or a region of integrally formed balancing masses centred on each balancing point, as described with reference to FIG. 8.

As a second option, consider a first point 101, which is the point of the bladder wall 11 that is closest to the combined centre of mass of the two electronic devices 2*a*, and a second point 102 opposite the first point. The distributed balancing mass may be provided by any mass distributed around this second point 102 and closer to the second point than the first point. In FIG. 10, a circular track 114 is shown extending around the second point and which also passes through the two balancing points 111, 112 mentioned in connection with the first option of the preceding paragraph, although this is not essential. This circular track 114 defines a plane, such that the first point 101 is perpendicularly offset from the plane from a centre point of the circle, as illustrated by the arrow P. Distributing mass evenly along this circular track 114, and particularly, evenly with respect to the balancing points 111, 112, will substantially allow for both of the criteria set out in equations (1) to (3) above to be met. The mass may be distributed along this track using any of the techniques described above with respect to FIGS. 3A to 6B, including tracks of integrally formed balancing mass elements or a continuous strip attached on or over the bladder wall 11. Alternatively, four or more balancing mass elements may be arranged along this circle, in line with FIG. 2C.

Figure 11:
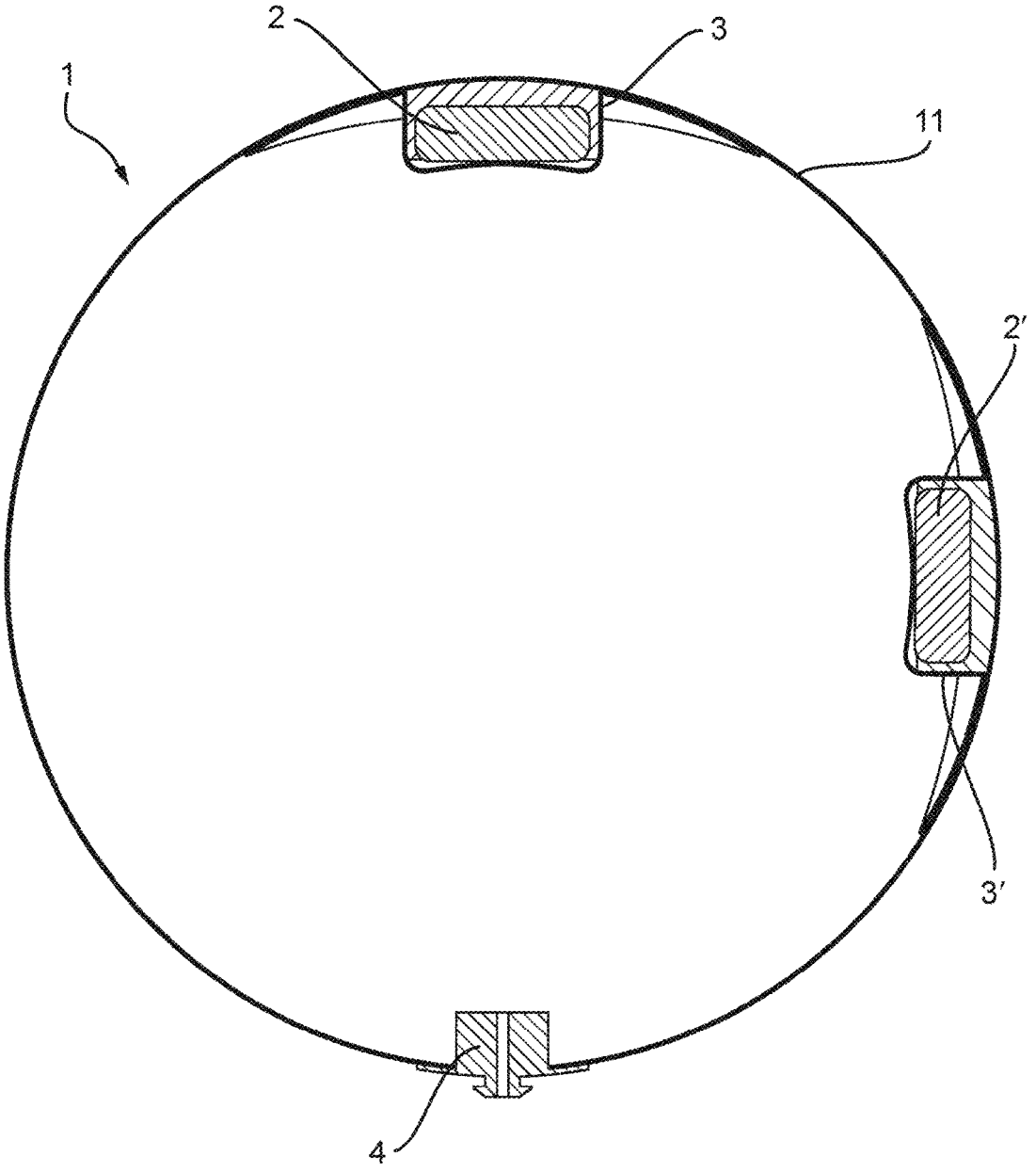
FIG. 11 is a schematic cross-section of a third example of an inflatable ball.
Figure 12:
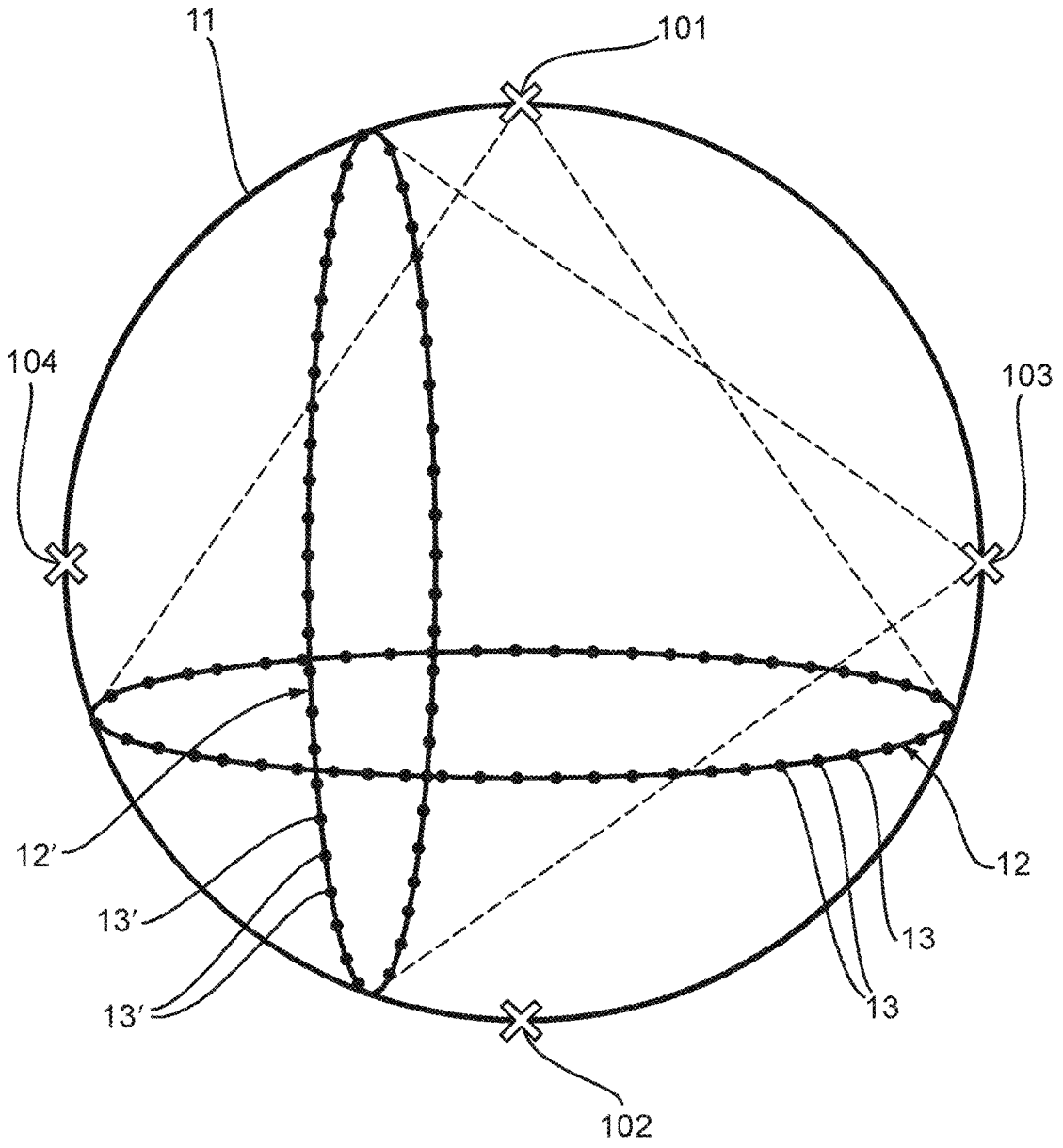
FIG. 12 schematically illustrates a balancing arrangement for the inflatable of FIG. 11.

Finally, FIG. 11 shows a ball 1 with a bladder 10 having bladder wall 11 and valve 4, as described above with respect to FIG. 1. A first electronic device 2 is provided in a first housing 3, which is constructed and arranged identically to that described above with respect to FIG. 1. Additionally, this ball 1 comprises a second electronic device 2' secured in a second housing 3', which is adhered to an inner surface of the bladder wall. It is possible to address and balance the masses of these electronic devices separately from one another, essentially ignoring any effect of the other. If we take a ball that has been balanced in accordance with the technique of FIG. 2A, for example. This ball now has essentially the same centre of mass and moment of inertia about any axis as a ball without an electronic device and distributed balancing mass. Therefore a second device may be balanced in just the same way as the first. FIG. 12 illustrates this.

In FIG. 12, the first electronic device 2 of the ball of FIG. 11 defines a first point 101, which is the point on the bladder wall 11 that substantially coincides with the centre of mass of that electronic device. A second point 102 is defined opposite the first point. The mass of the first electronic device 2 is balanced by a track of integrally formed balancing elements 13 extending along the circumference of a circle defining a cone together with the first point, as described above with respect to FIG. 3A. Additionally, the second electronic device 2' defines a third point on the bladder wall 11 that substantially coincides with the centre of mass of that second electronic device. A fourth point 104 is defined opposite to the third point. Again, that third point may be taken as the first vertex of a regular tetrahedron defined by four points lying in the bladder wall, and then the other three points of that tetrahedron used to describe a circular track around the bladder wall so that another cone is defined, wherein the third point is offset perpendicularly from the plane of this circle from the centre of the circle. This described circular track may be provided with a series of integrally formed balancing mass elements 13', which collectively form a second distributed balancing mass 12' in the same way as the first track of balancing mass elements 13 that was defined with respect to the first point.

Figure 13:
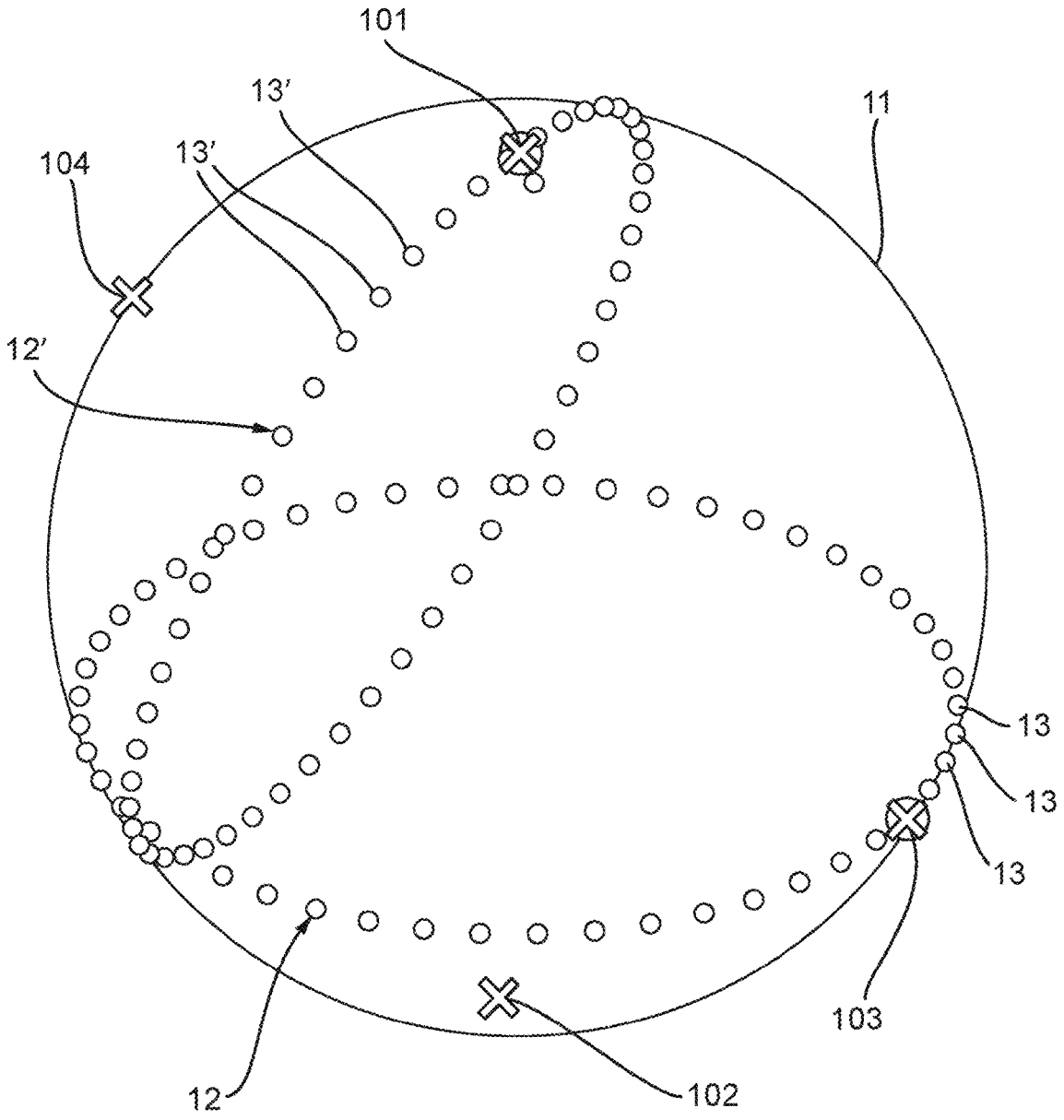
FIG. 13 schematically illustrates a balancing arrangement for another inflatable ball.

FIG. 13 illustrates another balancing arrangement that is a variant of the arrangement of FIGS. 11 and 12. In FIG. 13, a first electronic device is located at a first point 101 on the bladder wall 11. It is assumed that the electronic device essentially coincides with this first point. The position also defines a second point 102 opposite the first point and the first electronic device. A second electronic device is located at a third point 103 on the bladder wall. If the first point is considered the first vertex of a regular tetrahedron that is circumscribed by the sphere defined by the bladder wall 11, then the third point corresponds to another one of the four vertices. The position of the second electronic device also defines a fourth point 104 opposite the third point.

The first electronic device located at the first point 101 is balanced by a first distributed balancing mass 12. The first distributed balancing mass is formed of a track of balancing mass elements 13 along the bladder wall 11. The track of balancing mass elements 13 define the circumference of a circle, which together with the first point define an inscribed cone. The position of the balancing mass elements is defined using the same method as FIG. 3A. In particular, the regular tetrahedron circumscribed by the sphere of the bladder wall is found where a first vertex is the first point 101. The circular track of balancing mass elements is thus defined by the plane defined by the other three vertices. Because of this arrangement, the second electronic device at point 103 lies along the track defined by the distributed balancing mass 12.

The second electronic device located at the third point 103 is balanced by a second distributed balancing mass 12'. The second distributed balancing mass is formed of a track of balancing mass elements 13' along the bladder wall 11. The track of balancing mass elements 13' define the circumference of a circle, which together with the third point define an inscribed cone. The position of the balancing mass elements is defined in the same way as for the first electronic device. In particular, the regular tetrahedron circumscribed by the sphere of the bladder wall is found where a first vertex is the third point 103. The circular track of balancing mass elements is thus defined by the plane defined by the other three vertices. Because of this arrangement, the first electronic device at point 101 lies along the track defined by the second distributed balancing mass 12'.

Figure 14:
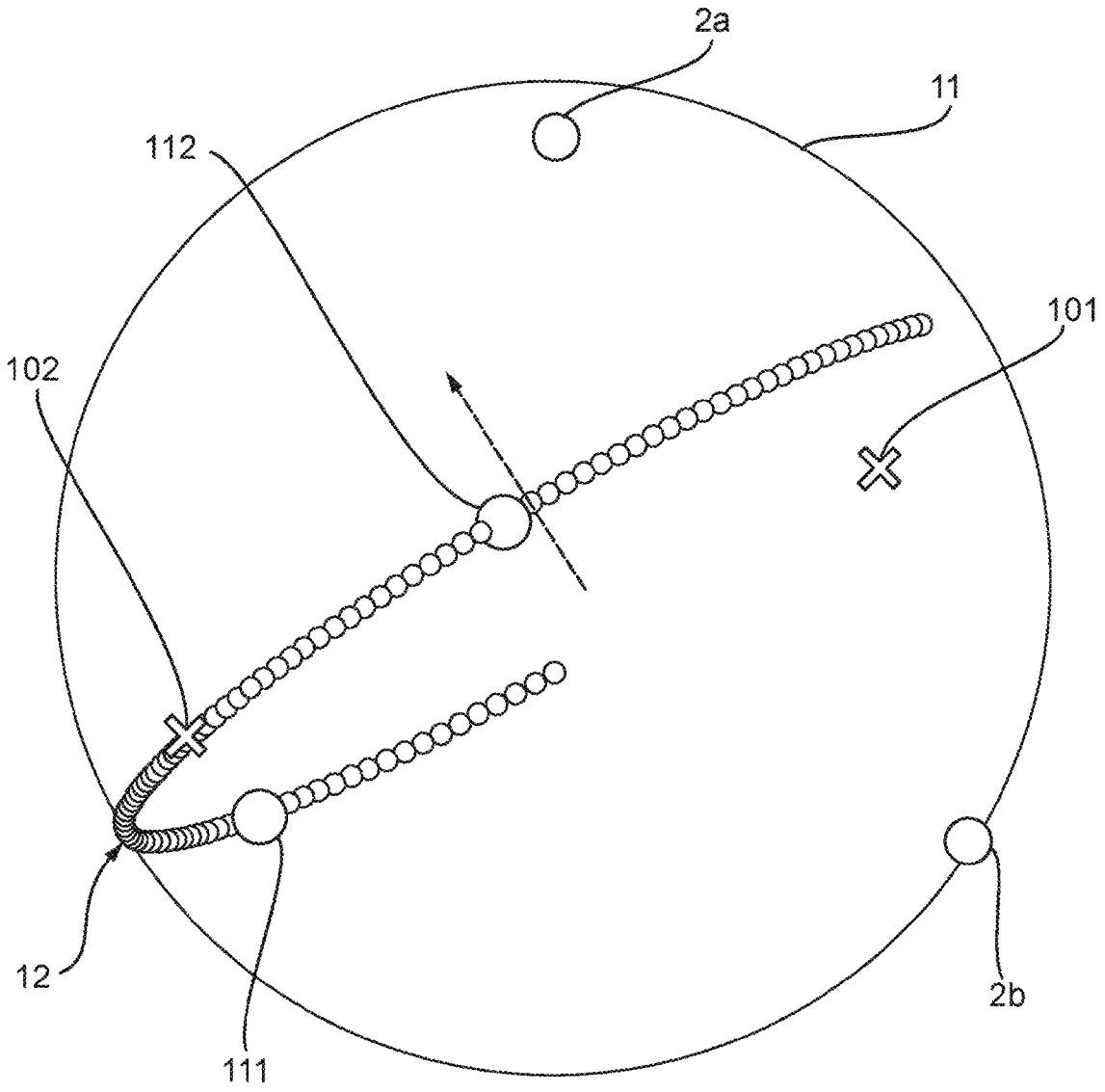
FIG. 14 schematically illustrates a balancing arrangement for another inflatable ball.

FIG. 14 shows another embodiment for balancing first and second electronic devices 2*a*, 2*b*. These two electronic devices are located at two of the four vertices of a regular tetrahedron circumscribed by the sphere of the bladder wall. The other two vertices define first and second balancing points 111, 112. A first point on the bladder wall 101 is the point on the bladder wall 11 closest to the centre of mass of the two electronic devices. If the two electronic devices have the same mass, this point will be equidistant between the two electronic devices 2*a*, 2*b*. A second point 102 is defined opposite this first point. The first and second balancing points 111, 112 are positioned around the second point 102, separated by 180° measured about the second point, and the first and second balancing points are closer to the second point 102 than the first point 101. In this embodiment, the distributed balancing mass 12 is formed by a track of small balancing mass elements, the track extending along a line of a great circle that passes through the first and second balancing points 111, 112 and through the second point 102. The track defines only part of this great circle, in particular the track extends two thirds of the way around the bladder wall, that two thirds being centred on the second point 102, such that the track may be considered as having two halves, each centred on the first and second balancing points 111, 112. In this case, some balancing mass elements may be provided that are closer to the first point than the second point; however, the ball still comprises some (indeed most) balancing mass elements positioned around the second point and closer to the first point than the second. A longer or shorter track could be used, or two separate shorter tracks could be used, each respectively centred on one of the first and second balancing points, 111, 112.

While the embodiments of FIGS. 12 to 14 tracks of small, spaced balancing mass elements, it should be appreciated that these tracks could also be formed by continuous strips, in the same way as FIG. 6A. Alternatively, fewer more massive balancing mass elements could be used, in the case of FIGS. 12 and 13, down to singular balancing mass elements on the vertices of the or each regular tetrahedron defined with respect to the first point, and third point, if provided.

Figure 15A:
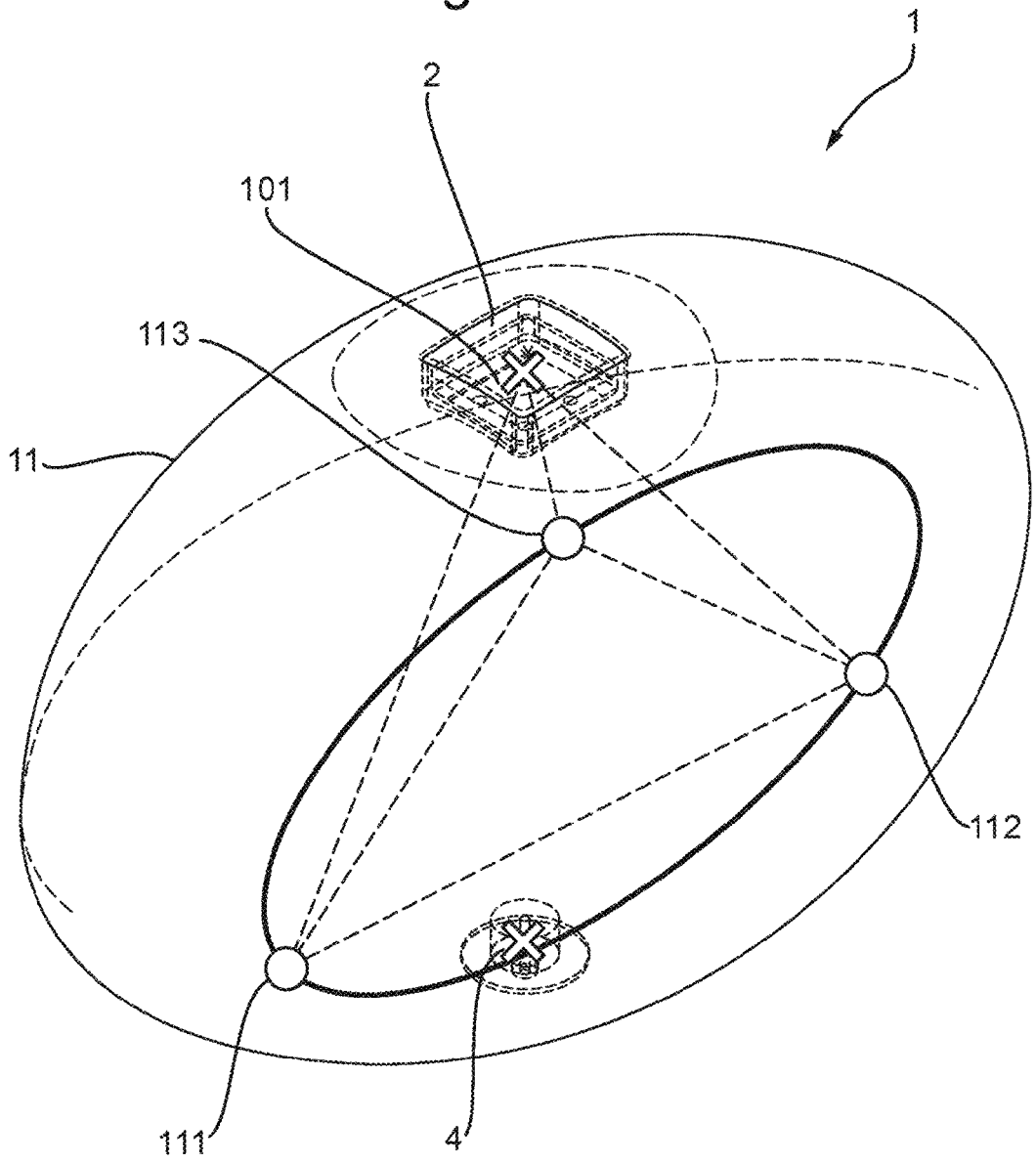
FIGS. 15A and 15B schematically illustrate two different balancing arrangements for another inflatable ball.
Figure 15B:
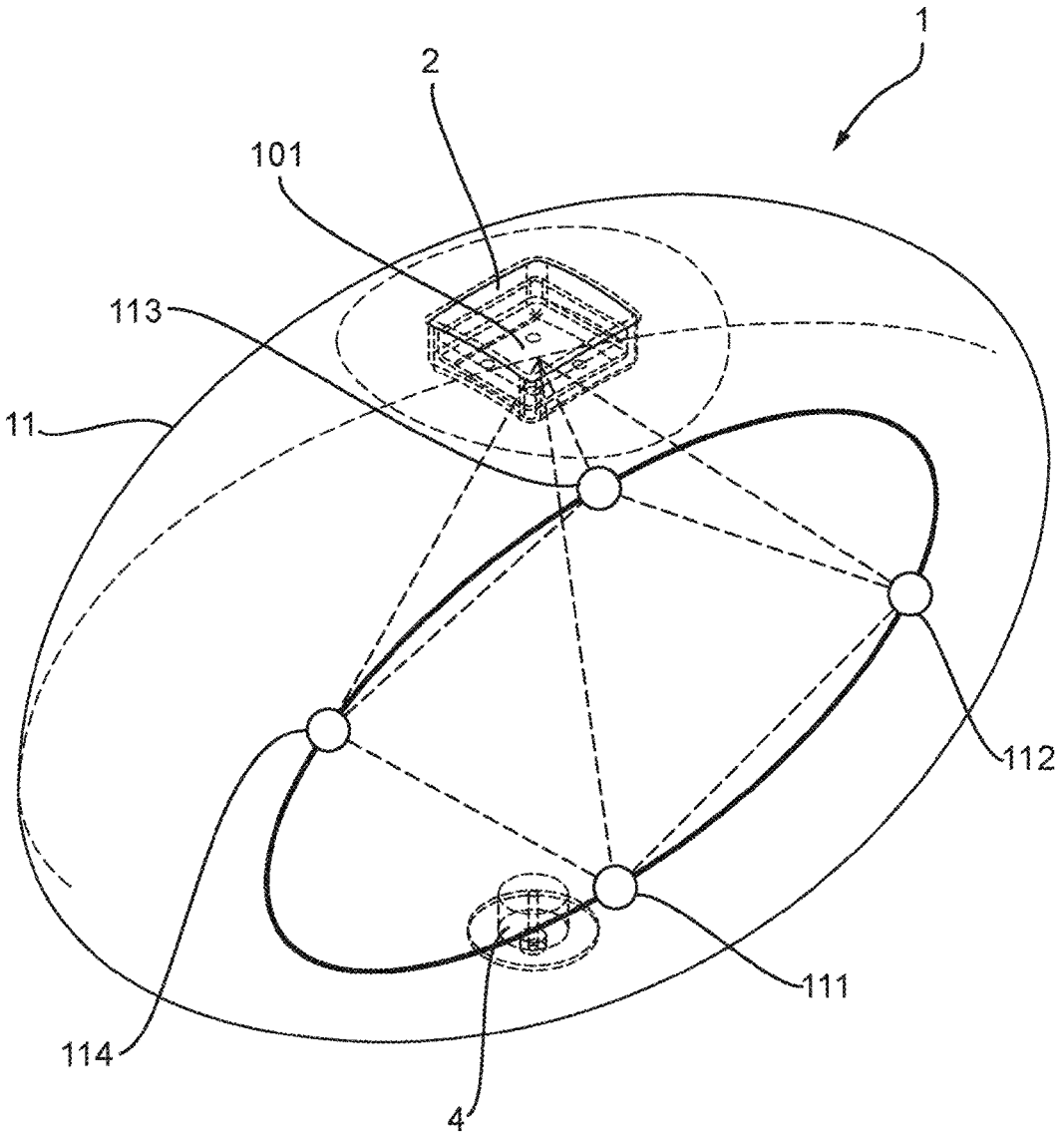

Finally, FIGS. 15A and 15B illustrates the extension of the above principles to prolate spheroid-shaped balls. The ball 1 again comprises a bladder wall 11 defining the inflated shape of the ball. An electronic device 2 is provided. The device is positioned on the inner surface of the bladder wall at a position half way along the length of the ball. The valve 4 is positioned opposite to the electronic device, although because of the present balancing arrangement, this is not essential. In FIG. 15A, the position of the electronic device 2 defines a first point 101 that substantially coincides with the position of the electronic device 2 on the bladder wall 11, and defines a second point 102 opposite the first point, i.e. coincident with the valve 4. First, second and third balancing points 111, 112, 113 are defined by vertices of a tetrahedron whose four vertices coincide with the bladder wall and which has a first vertex at the first point 101. The first, second and third balancing points 111, 112, 113 define an ellipse, wherein the first point 101 is perpendicularly offset from a centre point of the ellipse. The first balancing point 111 is located at the vertex of this ellipse. The second balancing point 112 is located between the second vertex of the ellipse and a first co-vertex of the ellipse. The third balancing point 112 is located between the second vertex and a second co-vertex of the ellipse opposite to the first co-vertex. The first, second and third balancing points are positioned such that a centre of mass of three identical masses positioned on those balancing points will lie on the axis extending between the first and second points 101, 102.

With the above balancing points defined, the mass of the electronic device 2 may be balanced in the prolate spheroid ball 1 by arranging balancing mass elements with respect to these three balancing points. The balancing mass elements could take the form of three essentially point mass elements, analogous to FIG. 2A, or could be arranged along tracks along the ellipse analogous to FIG. 3A, 4, 5A, or 6. They could also be distributed around the three balancing points analogously to FIG. 7A or 8A.

FIG. 15B shows a variant in which four balancing mass elements 13 are provided on four balancing points 111, 112, 113, 114. Consider the same ellipse defined by the tetrahedron described with reference to FIG. 15A. The four balancing points 111, 112, 113, 114 of this embodiment are evenly spaced around this ellipse, such that one balancing point is provided between each vertex and co-vertex of the ellipse. Like FIG. 2C, this reduces the required mass of each balancing mass element while still attaining satisfactory balancing of the electronic device 101.

The invention may also be understood with reference to the following numbered clauses:

Clause 1. An inflatable ball comprising: a bladder having a bladder wall defining an inflatable interior of the ball; at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing the mass of the at least one device, the distributed balancing mass comprising one or more balancing mass elements on or over the bladder wall, the one or more balancing mass elements being arranged at a plurality of locations spaced around the second point on the bladder wall and closer to the second point than the first point.

Clause 2. An inflatable ball according to clause 1, wherein the one or more balancing mass elements comprises one or more balancing mass elements arranged substantially at or substantially evenly distributed by mass with respect to each of at least two balancing points equally spaced around the second point, preferably at least three balancing points equally spaced around the second point.

Clause 3. An inflatable ball according to clause 1 or clause 2, wherein the one or more balancing mass elements comprises one or more balancing mass elements arranged substantially at or substantially evenly distributed by mass with respect to each of at least three balancing points spaced around the second point, the three balancing points together with the first point and/or the centre of mass of the of the at least one device defining four vertices of a substantially regular tetrahedron.

Clause 4. An inflatable ball according to any of the preceding clauses, comprising at least six balancing mass elements arranged substantially in a single plane, wherein each balancing mass element has, among the other of the at least six balancing mass elements, two corresponding balancing mass elements, wherein each balancing mass element together with its two corresponding balancing mass elements and together with the first point and/or the centre of mass of the at least one device defines four vertices of a substantially regular tetrahedron.

Clause 5. An inflatable ball according to any of the preceding clauses, wherein the one or more balancing mass elements comprises one or more mass balancing elements arranged along one or more tracks along the bladder wall defining all or part(s) of the circumference of a circle or an ellipse.

Clause 6. An inflatable ball according to clause 5, wherein the first point lies perpendicular to the plane of the circle or the ellipse from the centre of the circle or the ellipse.

Clause 7. An inflatable ball according to clause 5, wherein the at least one device comprises a first device and a second device, wherein the one or more tracks along the bladder wall pass through first and second balancing points spaced around the second point and define part(s) of the circumference of a circle or an ellipse passing between the first and second devices.

Clause 8. An inflatable ball according to any of the preceding clauses, wherein the one or more balancing mass elements comprises one or more continuous strips or patches, preferably adhesive strips or patches, attached on or over the bladder wall.

Clause 9. An inflatable ball according to any of the preceding clauses, wherein the one or more balancing mass elements comprises one or more balancing mass elements formed integrally with the bladder wall.

Clause 10. An inflatable ball according to clause 9, comprising a plurality of balancing mass elements formed integrally with the bladder wall by increased wall-thickness portions of the bladder wall.

Clause 11. An inflatable ball according to clause 10, wherein each increased wall-thickness portion has at least one lateral dimension of no more than 2 cm, preferably no more than 1 cm, more preferably no more than 0.5 cm.

Clause 12. An inflatable ball according to clause 11, wherein each increased wall-thickness portion has a largest lateral dimension of no more than 2 cm, preferably no more than 1 cm, more preferably no more than 0.5 cm.

Clause 13. An inflatable ball according to any of clauses 10 to 12, wherein each increased wall-thickness portion of the bladder wall is surrounded by a portion not having the increased wall thickness.

Clause 14. An inflatable ball according to any of clauses 10 to 13, wherein each increased wall-thickness portion projects from an inner surface of the bladder wall towards the centre of the inflatable interior of the ball.

Clause 15. An inflatable ball according to any of clauses 10 to 14, wherein the wall thickness of the increased wall-thickness portions is no more than five times the wall thickness of the thinnest part of the bladder wall, preferably no more than four times the thickness, even more preferably no more than three times the thickness, most preferably no more than twice the thickness of the thinnest part of the bladder wall.

Clause 16. An inflatable ball according to any of the preceding clauses, wherein the at least one device balanced by the distributed balancing mass is mounted at a substantially single point on or over the bladder wall.

Clause 17. An inflatable ball according to any of the preceding clauses, wherein the at least one device is a first device or first set of devices, and further comprising a second device or second set of devices mounted on or over the bladder wall such that a centre of mass of the second device or second set of devices is located away from a centre of the inflatable interior of the ball, the centre of mass of the second device or second set of devices defining a third point on the bladder wall coincident with or closest to the centre of mass of the second device or second set of devices and a fourth point on the bladder wall opposite the third point; and a second distributed balancing mass for at least partially rotationally balancing the mass of the second device or second set of devices, the distributed balancing mass comprising one or more balancing mass elements on or over the bladder wall, the one or more balancing mass elements being arranged at a plurality of locations spaced around the fourth point on the bladder wall and closer to the fourth point than the third point.

Clause 18. An inflatable ball according to any of the preceding clauses, wherein the or each electronic device comprises one or more of: a battery, a wireless charging module, an accelerometer, a gyroscope, a pressure sensor, a magnetometer, a force transducer and a location tracking device, such as an ultra-wideband transmitter and/or receiver.

Clause 19. An inflatable ball according to any of the preceding clauses, wherein the bladder further comprises a valve for inflating the inflatable interior of the ball, wherein the valve is not one the devices balanced by the distributed balancing mass.

Clause 20. An inflatable ball according to any of the preceding clauses, wherein the bladder defines a substantially spherical inflatable interior of the ball.

Clause 21. An inflatable ball according to any of the preceding clauses, wherein the inflatable ball is an inflatable sports ball, preferably a soccer ball, basketball, netball, volleyball, or handball.

Clause 22. A method of manufacturing an inflatable ball, the method comprising: providing a bladder having a bladder wall defining an inflatable interior of the ball; providing at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and providing a distributed balancing mass for at least partially rotationally balancing the mass of the at least one device, the distributed balancing mass comprising one or more balancing mass elements provided on or over the bladder wall, the one or more balancing mass elements being arranged at a plurality of locations spaced around the second point on the bladder wall and closer to the second point than the first point.

Clause 23. A method according to clause 22, wherein providing the distributed balancing mass comprises attaching one or more continuous strips or patches, preferably adhesive strips or patches, on or over the bladder wall.

Clause 24. A method according to clause 22 or clause 23, wherein providing the bladder comprises moulding the bladder, and wherein providing the distributed balancing mass comprises moulding one or more balancing mass elements integrally with the bladder wall when moulding the bladder.

Clause 25. A method according to clause 24, wherein moulding one or more balancing mass elements integrally with the bladder wall when moulding the bladder comprises moulding a plurality of increased wall-thickness portions of the bladder wall.

Clause 26. A method according to any of clauses 22 to 25, adapted to manufacture an inflatable ball according to any of clauses 1 to 21.

The invention claimed is:

1. An inflatable ball comprising:

a bladder having a bladder wall defining an inflatable interior of the ball;

at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing a mass of the at least one device, the distributed balancing mass comprising one or more balancing mass elements on or over the bladder wall, the one or more balancing mass elements being arranged at a plurality of locations spaced around the second point on the bladder wall and closer to the second point than the first point, wherein the one or more balancing mass elements are arranged on or over the bladder wall along one or more tracks along the bladder wall defining substantially all or one or more parts of the circumference of a circle or an ellipse, wherein the first point lies perpendicular to a plane of the circle of the ellipse from the centre of the circle or the ellipse, and wherein the one or more balancing mass elements are provided in a range more than 50% and less than 95% of a distance along the bladder wall from the first point to the second point, and wherein each track comprises a continuous strip attached on or over the bladder wall and that is elongated along the track, wherein the distributed balancing mass has a total mass of at least 1.5 times the mass of the at least one device and less than 8 times the mass of the at least one device.

2. An inflatable ball according to claim 1, wherein each elongate continuous strip comprises a plurality of increased thickness portions of the strip separated by reduced thickness portions of the strip.

3. An inflatable ball according to claim 1, wherein the first point and the one or more balancing mass elements arranged along one or more tracks are located on a virtual cone shape, the first point being located at the tip of the virtual cone and the one or more balancing mass elements extending around the base of the virtual cone.

4. An inflatable ball according to claim 1, wherein the distributed balancing mass has a total mass of between 2 times and 4 times the mass of the at least one device.

5. An inflatable ball according to claim 1, wherein the one or more tracks extend along at least 50% of the circumference of the circle or ellipse.

6. An inflatable ball comprising:

a bladder having a bladder wall defining an inflatable interior of the ball;

at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing a mass of the at least one device, the distributed balancing mass comprising one or more balancing mass elements on or over the bladder wall, the one or more balancing mass elements being arranged at a plurality of locations spaced around the second point on the bladder wall and closer to the second point than the first point, wherein at least one of the one or more balancing mass elements is attached on or over the bladder wall and comprises a plurality of increased-thickness portions separated by reduced-thickness portions wherein the increased-thickness portions and the reduced-thickness portions are integrally formed with each other, and wherein the distributed balancing mass has a total mass of at least 1.5 times the mass of the at least one device and less than 8 times the mass of the at least one device.

7. An inflatable ball according to claim 6, wherein each increased-thickness portion has a largest dimension of no more than 4 cm.

8. An inflatable ball according to claim 6, wherein each increased-thickness portion has a thickness at least twice the thickness of a thinnest part of the respective balancing mass element.

9. An inflatable ball according to claim 6, wherein each reduced-thickness portion has a thickness of no more than 0.5 cm.

10. An inflatable ball according to claim 6, wherein each balancing mass element is a continuous strip.

11. An inflatable ball according to claim 6, wherein each balancing mass element is an adhesive strip or patch.

12. An inflatable ball comprising:

a bladder having a bladder wall defining an inflatable interior of the ball;

at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing a mass of the at least one device, the distributed balancing mass comprising one or more balancing mass elements on or over the bladder wall, the one or more balancing mass elements being arranged at a plurality of locations spaced around the second point on the bladder wall and closer to the second point than the first point, wherein the first point and the distributed balancing mass are located on a virtual cone shape, the first point being located at the tip of the virtual cone and the one or more balancing mass elements being substantially evenly distributed by mass around the base of the virtual cone, wherein the one or more balancing mass elements comprises at least four balancing mass elements provided in a range more than 50% and less than 95% of a distance along the bladder wall from the first point to the second point, wherein the distributed balancing mass has a total mass of at least 1.5 times the mass of the at least one device and less than 8 times the mass of the at least one device.

13. An inflatable ball according to claim 12, wherein the distributed balancing mass has a total mass of between 2 times and 4 times the mass of the at least one device.

14. An inflatable ball according to claim 12, wherein the one or more balancing mass elements comprises at least six balancing mass elements provided in the range more than 50% and less than 95% of the distance along the bladder wall from the first point to the second point.

15. An inflatable ball comprising:

a bladder having a bladder wall defining an inflatable interior of the ball;

at least one device mounted on or over the bladder wall such that a centre of mass of the at least one device is located away from a centre of the inflatable interior of the ball, the at least one device including at least one electronic device, the centre of mass of the at least one device defining a first point on the bladder wall coincident with or closest to the centre of mass of the at least one device and a second point on the bladder wall opposite the first point; and a distributed balancing mass for at least partially rotationally balancing a mass of the at least one device, the distributed balancing mass comprising one or more balancing mass elements on or over the bladder wall, the one or more balancing mass elements being arranged at a plurality of locations spaced around the second point on the bladder wall and closer to the second point than the first point, wherein the one or more balancing mass elements are arranged on or over the bladder wall along one or more tracks along the bladder wall defining substantially all or one or more parts of the circumference of a circle or an ellipse, wherein the first point lies perpendicular to a plane of the circle or the ellipse from the centre of the circle or the ellipse, and wherein the one or more balancing mass elements are provided in a range more than 50% and less than 95% of the distance along the bladder wall from the first point to the second point, and wherein each track comprises a series of at least five balancing mass elements arranged in a line extending along the respective track in which each balancing mass element is spaced from a next balancing mass element within the same track by no more than 2 cm, wherein the distributed balancing mass has a total mass of at least 1.5 times the mass of the at least one device and less than 8 times the mass of the at least one device.

* * * * *